US009842719B2

(12) United States Patent
Shea et al.

(10) Patent No.: US 9,842,719 B2
(45) Date of Patent: Dec. 12, 2017

(54) FUSIBLE SWITCH DISCONNECT DEVICE FOR DC ELECTRICAL POWER SYSTEM

(71) Applicant: COOPER TECHNOLOGIES COMPANY, Houston, TX (US)

(72) Inventors: John Joseph Shea, Pittsburgh, PA (US); Hongbin Wang, Novi, MI (US); Paul J. Rollmann, Menomonee Falls, WI (US); Matthew Rain Darr, Edwardsville, IL (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 15/015,500

(22) Filed: Feb. 4, 2016

(65) Prior Publication Data

US 2017/0229274 A1 Aug. 10, 2017

(51) Int. Cl.
*H01H 85/20* (2006.01)
*H01H 89/04* (2006.01)

(52) U.S. Cl.
CPC ..... *H01H 89/04* (2013.01); *H01H 85/203* (2013.01); *H01H 2235/01* (2013.01)

(58) Field of Classification Search
CPC ... H01H 89/04; H01H 85/203; H01H 2235/01
USPC ..... 337/194
See application file for complete search history.

(56) References Cited

U.S. PATENT DOCUMENTS 3,958,197 A * 5/1976 Gryctko ..... H01H 83/22 335/18
3,958,204 A * 5/1976 Gryctko ..... H01H 71/121 335/18
5,969,587 A * 10/1999 Combas ..... H01H 85/545 335/132
5,990,439 A 11/1999 Pever
6,717,505 B1 * 4/2004 Bruchmann ..... H01H 85/32 337/187
7,474,194 B2 * 1/2009 Darr ..... H01H 9/104 337/59
7,495,540 B2 * 2/2009 Darr ..... H01H 9/104 337/143
7,924,136 B2 * 4/2011 Darr ..... H01H 9/104 337/143
8,854,174 B2 * 10/2014 Su ..... H01H 9/104 337/143
9,552,951 B2 * 1/2017 Douglass ..... H01H 89/04
(Continued)

FOREIGN PATENT DOCUMENTS

CA 2951428 A1 1/2016
GB 800364 8/1958
WO 0249053 A1 6/2002

OTHER PUBLICATIONS

International Search Report and Written Opinion of International Application No. PCT/US2017/012686, Apr. 26, 2017, 15 pages.

*Primary Examiner* — Anatoly Vortman
(74) *Attorney, Agent, or Firm* — Armstrong Teasdale LLP

(57) ABSTRACT

A fusible disconnect switch devices includes dual sets of switch contacts to connect or disconnect a current path through an overcurrent protection fuse with reduced arcing severity. Faster acting and longer contact path switch mechanisms are described providing satisfactory switching of DC circuits without excessive electrical arcing in a reduced physical package size.

26 Claims, 14 Drawing Sheets

(56) References Cited

U.S. PATENT DOCUMENTS

| | | | | |
|---|---|---|---|---|
| 2006/0055498 | A1* | 3/2006 | Darr | H01H 9/104 337/143 |
| 2006/0125596 | A1* | 6/2006 | Darr | H01H 9/104 337/194 |
| 2007/0252670 | A1* | 11/2007 | Darr | H01H 9/104 337/143 |
| 2011/0169599 | A1 | 7/2011 | Darr et al. | |
| 2011/0221563 | A1* | 9/2011 | Su | H01H 9/104 337/149 |
| 2016/0163491 | A1* | 6/2016 | Neyens | H01H 1/5833 337/195 |
| 2016/0260571 | A1* | 9/2016 | Douglass | H01H 89/04 |

* cited by examiner

STATE OF THE ART

FUSIBLE SWITCH DISCONNECT DEVICE FOR DC ELECTRICAL POWER SYSTEM

BACKGROUND OF THE INVENTION

The field of the invention relates generally to circuit protection devices for electrical power systems, and more specifically to fusible switch disconnect devices for protecting direct current (DC) circuitry.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current through the fuse exceeds a predetermined limit, the fusible elements melt and open one or more circuits through the fuse to prevent electrical component damage.

A variety of fusible disconnect devices are known in the art wherein fused output power may be selectively switched from a power supply. Existing fusible disconnect switch devices, however, have not completely met the needs of those in the art and improvements are desired.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Fusible circuit protection devices are sometimes utilized in an array on electrical panels and the like in an electrical power distribution system. Each fusible circuit protection device includes a single fuse or multiple fuses depending on the application, and each fusible circuit protection device protects load side circuitry from overcurrent conditions and the like that may potentially damage load side systems and components.

One type of fusible circuit protection device is a fusible switch disconnect device. In such fusible switch disconnect devices, switch contacts are provided to make or break electrical connection to and through their respective fuses. Fusible switch disconnect devices can be advantageous from a number of perspectives, but are nonetheless disadvantaged in certain applications.

For example, while conventional fusible switch disconnect devices are satisfactory for breaking alternating current (AC) circuitry by operation of a switch contact, the switching of high energy DC circuitry can be problematic. When switched under load, electrical arcing is typically generated at the switch contacts. Unlike AC current, where such arcing has an opportunity to extinguish at any voltage zero crossing of the alternating voltage wave, the DC current and voltage potential remain at a constant level during the breaking of switch contacts making it very difficult for the arc to extinguish. This constant DC voltage potential further tends to create sustained arcing conditions that will erode the switch contacts very quickly. Sustained high temperatures associated with DC arcing conditions can contribute to further switch mechanism degradation, and perhaps may even lead to catastrophic failure of the fusible switching disconnect device if not carefully controlled. Of course, as the voltage of the DC circuitry increases, electrical arcing issues become more severe.

To safely contain arc energy inside the housings of the fusible switch disconnect device, known fusible switch disconnect devices are relatively large devices. Larger fusible switch disconnect devices tend to be more expensive than smaller ones, and following general trends to reduce component size in the electrical industry smaller fusible disconnect switch devices are desired in the marketplace. Balancing the need to contain arc energy with a desire for smaller fusible switch disconnect devices, however, presents practical challenges. Improvements to fusible switch disconnect devices are accordingly desired that facilitate a more compact and lower cost solution to protect DC circuitry than has heretofore been provided.

Figure 1:
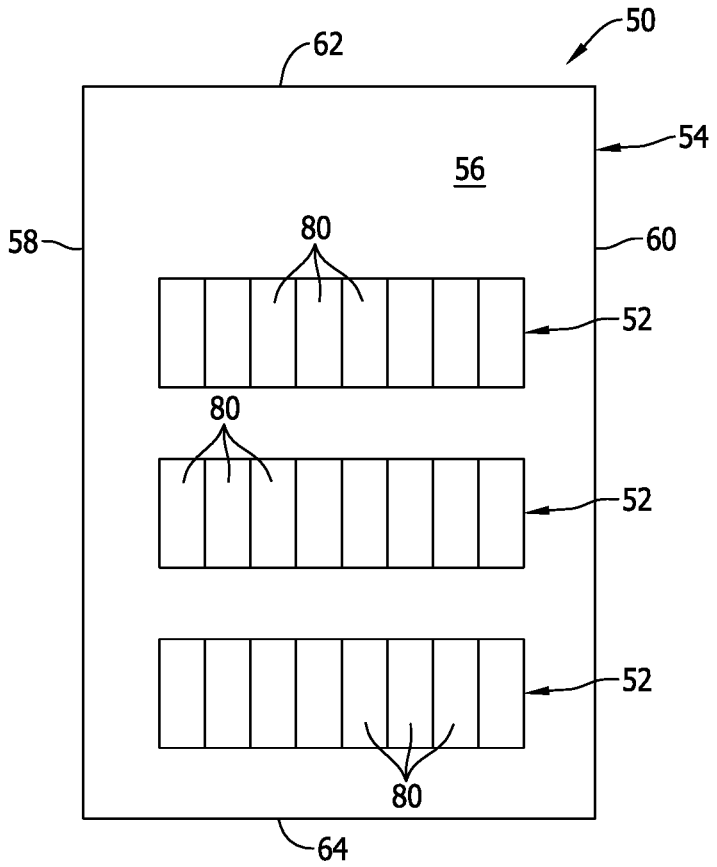
FIG. 1 is a front view of an array of fusible circuit protection devices.

FIG. 1 illustrates an array 50 of fusible circuit protection devices 80 that may pose electrical arcing issues and that may benefit from the improvements described below when utilized to protect high energy, DC circuitry. In the illustrated example, the fusible circuit protection devices 80 are arranged in a plurality of rows 52 wherein the devices 80 are arranged side-by-side with eight such devices 80 in each row. In the example shown, three rows 52 are depicted for a total of twenty-four devices 80 in the array 50. However, even greater numbers of rows may be provided depending on the power system being protected. Also, it is understood that the devices 80 may be arranged in columns instead or rows, or in columns and rows as desired.

The rows 52 of devices 80 may further be provided in an enclosure 54 including a base wall 56, lateral side walls 58 and 60 depending from the base wall 56, end walls 62 and 64 depending from the base wall 56 and interconnecting the side walls 58 and 60, and an optional lid. The rows 52 of devices 80 may be mounted to a DIN Rail (not shown in FIG. 1) extending on the base wall 56. The enclosure 54 is sometimes referred to as a combiner box wherein a relatively large number of electrical connections, both line side and load side in the power system, are established. The combiner box may be mounted vertically or horizontally at any location necessary or desired. In other applications, the enclosure 54 may be referred to as an electrical panel, control panel, or panelboard that also accommodates other electrical components besides the fusible circuit protection devices 80.

In normal operation, current flows from the line side of an electrical power system through each device 80 and the fuse therein to the load side protected circuitry. Using the switches provided in the devices 80, the load side circuitry associated with the devices 80 may be electrically isolated from the line side, independent of any operation of the fuse itself. As such, the devices 80 may desirably be switched on and off without having to remove the fuses. The switches of such devices may be opened manually or automatically in response to detected circuit conditions, even in anticipation of an opening of the fuse.

The possible opening and closing of the switches, whether manually or automatically, in a relatively large number of devices 80 in close proximity to one another requires effective arc energy containment when the circuitry protected is high energy, high voltage DC circuitry. As such, and as mentioned above, the devices 80 as conventionally implemented tend to increase in size as the voltage and current increases for the electrical power system to be protected. Considering the number of such devices 80 in the array 50, however, any reduction in size of the devices 80 on the component level may result in significant reduction of size of the array 50 on a systems level.

Figure 2:
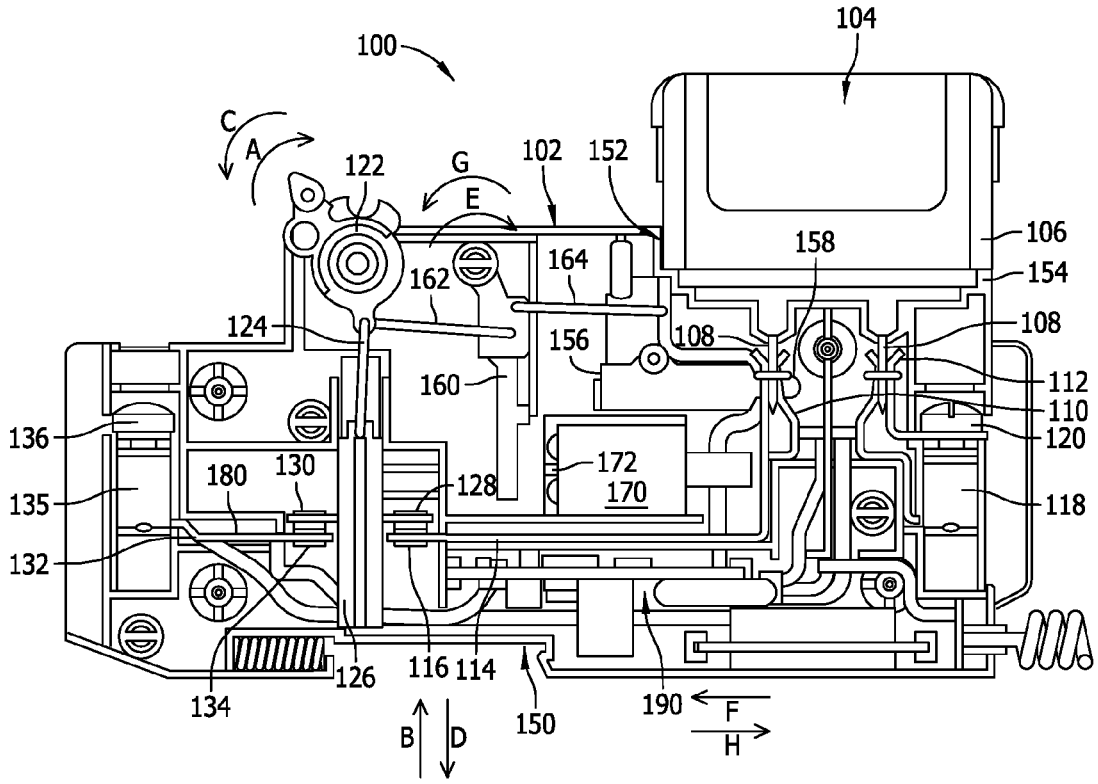
FIG. 2 is a side elevational view of a portion of an exemplary embodiment of a known fusible switching disconnect device that may be used in the array shown in FIG. 1.

FIG. 2 is a side elevational view of a portion of an exemplary embodiment of a fusible switching disconnect device 100 that may be utilized as the device 80 in the array 50 shown in FIG. 1 and that has already succeeded in reducing the size of an array 50 in certain power systems as well as provides other benefits. The disconnect device 100 generally includes a disconnect housing 102 and a finger-safe rectangular fuse module 104 having terminal blades received in pass through openings in the top of the disconnect device 100 such that the fuse module 104 can be plugged-in to the disconnect housing 102 or removed from the disconnect housing 102 by hand by grasping the exposed housing of the rectangular fuse module 104 and either pushing it toward the disconnect housing 102 to engage the terminal blades or pulling it away from the disconnect housing 102 to disengage the terminal blades from connecting terminals in the disconnect housing 102. Such an arrangement has been well received and one of its benefits is that it does not require conventional tools to engage or disengage conventional fasteners to remove or install the fuse module 104.

The device 100 includes a disconnect housing 102 fabricated from an electrically nonconductive or insulative material such as plastic, and the disconnect housing 102 is configured or adapted to receive a retractable rectangular fuse module 104. The disconnect housing 102 and its internal components described below, are sometimes referred to as a base assembly that receives the retractable fuse module 104. The internal components of the disconnect housing 102 include switching elements and actuator components described further below, although it should be understood that the disconnect housing 102 and its internal components represent only one example of a possible disconnect device that may benefit from the inventive features described further below.

The fuse module 104 in the exemplary embodiment shown includes a rectangular housing 106 fabricated from an electrically nonconductive or insulative material such as plastic, and conductive terminal elements in the form of terminal blades 108 extending from the housing 106. In the example shown, the terminal blades 108 extend in spaced apart but generally parallel planes extending perpendicular to the plane of the page of FIG. 2. A primary fuse element or fuse assembly is located within the housing 106 and is electrically connected between the terminal blades 108 to provide a current path therebetween. Such fuse modules 104 are known and in one embodiment the rectangular fuse module 104 is a CUBEFuse™ power fuse module commercially available from Cooper Bussmann of St. Louis, Mo. The fuse module 104 provides overcurrent protection via the primary fuse element therein that is configured to melt, disintegrate or otherwise fail and permanently open the current path through the fuse element between the terminal blades 108 in response to predetermined current conditions flowing through the fuse element in use. When the fuse element opens in such a manner, the fuse module 104 must be removed and replaced to restore affected circuitry.

A variety of different types of fuse elements, or fuse element assemblies, are known and may be utilized in the fuse module 104 with considerable performance variations in use. Also, the fuse module 104 may include fuse state indication features, a variety of which are known in the art, to identify the permanent opening of the primary fuse element such that the fuse module 104 can be quickly identified for replacement via a visual change in appearance when viewed from the exterior of the fuse module housing 106. Such fuse state indication features may involve secondary fuse links or elements electrically connected in parallel with the primary fuse element in the fuse module 104.

A conductive line side fuse clip 110 may be situated within the disconnect housing 102 and may receive one of the terminal blades 108 of the fuse module 104. A conductive load side fuse clip 112 may also be situated within the disconnect housing 102 and may receive the other of the fuse terminal blades 108. The line and load side fuse clips 110, 112 may be biased with spring elements and the like to provide some resistance to the plug-in installation and removal of the respective terminal blades 108, and also to ensure sufficient contact force to ensure electrical connection therebetween when the terminal blades 108 and the fuse clips 110, 112 are engaged.

The line side fuse clip 110 may be electrically connected to a first line side terminal 114 provided in the disconnect housing 102, and the first line side terminal 114 may include a stationary switch contact 116. The load side fuse clip 112 may be electrically connected to a load side connection terminal 118. In the example shown, the load side connection terminal 118 is a box lug terminal operable with a screw 120 to clamp or release an end of a connecting wire to establish electrical connection with load side electrical circuitry. Other types of load side connection terminals are known, however, and may be provided in alternative embodiments.

A rotary switch actuator 122 is further provided in the disconnect housing 102, and is mechanically coupled to an actuator link 124 that, in turn, is coupled to a sliding actuator bar 126. The actuator bar 126 carries a pair of switch contacts 128 and 130. In an exemplary embodiment, the switch actuator 122, the link 124 and the actuator bar 126 may be fabricated from nonconductive materials such as plastic. A second conductive line side terminal 132 including a stationary contact 134 is also provided, and a line side connecting terminal 135 is also provided in the disconnect housing 102. In the example shown, the line side connection terminal 135 is a box lug terminal operable with a screw 136 to clamp or release an end of a connecting wire to establish electrical connection with line side electrical circuitry. Other types of line side connection terminals are known, however, and may be provided in alternative embodiments. While in the illustrated embodiment the line side connecting terminal 135 and the load side connecting terminal 118 are of the same type (i.e., both are box lug terminals), it is contemplated that different types of connection terminals could be provided on the line and load sides of the disconnect housing 102 if desired.

Electrical connection of the device 100 to power supply circuitry, sometimes referred to as the line side, may be accomplished in a known manner using the line side connecting terminal 135. Likewise, electrical connection to load side circuitry may be accomplished in a known manner using the load side connecting terminal 118. As mentioned previously, a variety of connecting techniques are known (e.g., spring clamp terminals and the like) and may alternatively be utilized to provide a number of different options to make the electrical connections in the field. The configuration of the connecting terminals 135 and 118 accordingly are exemplary only.

In the position shown in FIG. 2, the disconnect device 100 is shown in the closed position with the switch contacts 130 and 128 mechanically and electrically engaged to the stationary contacts 134 and 116, respectively. As such, when the device 100 is connected to line side circuitry with a first connecting wire via the line side connecting terminal 135, and also when the load side terminal 118 is connected to load side circuitry with a connecting wire via the connecting terminal 118, a circuit path is completed through conductive elements in the disconnect housing 102 and the fuse module 104 when the fuse module 104 is installed and when the primary fuse element therein is in a non-opened, current carrying state.

Specifically, electrical current flow through the device 100 is as follows when the switch contacts 128 and 130 are closed, when the device 100 is connected to line and load side circuitry, and when the fuse module 104 is installed. Electrical current flows from the line side circuitry through the line side connecting wire to and through the line side connecting terminal 135. From the line side connecting terminal 135 current then flows to and through the second line terminal 132 and to the stationary contact 134. From the stationary contact 134 current flows to and through the switch contact 130, and from the switch contact 130 current flows to and through the switch contact 128. From the switch contact 128 current flows to and through the stationary contact 116, and from the stationary contact 116 current flows to and through the first line side terminal 114. From the first line side terminal 114 current flows to and through the line side fuse clip 110, and from the line side fuse clip 110 current flows to and through the first mating fuse terminal blade 108 on the line side. From the first terminal blade 108 current flows to and through the primary fuse element in the fuse module 104, and from the primary fuse element to and through the second fuse terminal blade 108. From the second terminal blade 108 current flows to and through the load side fuse clip 112, and from the load side fuse clip 112 to and through the load side connecting terminal 118. Finally, from the connecting terminal 118 current flows to the load side circuitry via the wire connected to the terminal 118. As such, a circuit path or current path is established through the device 100 that includes the fuse element of the fuse module 104.

In the example shown, disconnect switching to temporarily open the current path in the device 100 may be accomplished in multiple ways. First, and as shown in FIG. 2, a portion of the switch actuator 122 projects through an upper surface of the disconnect housing 102 and is therefore accessible to be grasped for manual manipulation by a person. Specifically, the switch actuator 122 may be rotated from a closed position as shown in FIG. 2 to an open position in the direction of arrow A, causing the actuator link 124 to move the sliding bar 126 linearly in the direction of arrow B and moving the switch contacts 130 and 128 away from the stationary contacts 134 and 116. Eventually, the switch contacts 130 and 128 become mechanically and electrically disengaged from the stationary contacts 134 and 116 and the circuit path between the first and second line terminals 114 and 132, which includes the primary fusible element of the fuse module 104, may be opened when the fuse terminal blades 108 are received in the line and load side fuse clips 110 and 112.

When the circuit path in the device 100 is opened in such a manner via rotational displacement of the switch actuator 122, the fuse module 104 becomes electrically disconnected from the first line side terminal 132 and the associated line side connecting terminal 135. In other words, an open circuit is established between the line side connecting terminal 135 and the first terminal blade 108 of the fuse module 104 that is received in the line side fuse clip 110. The operation of switch actuator 122 and the displacement of the sliding bar 126 to separate the contacts 130 and 128 from the stationary contacts 134 and 116 may be assisted with bias elements such as springs. Particularly, the sliding bar 126 may be biased toward the open position wherein the switch contacts 130 and 128 are separated from the contacts 134 and 116 by a predetermined distance. The dual switch contacts 134 and 116 mitigate, in part, electrical arcing concerns as the switch contacts 134 and 116 are engaged and disengaged by dividing the arcing potential to two different locations.

Once the switch actuator 122 of the disconnect device 100 is switched open to interrupt the current path in the device 100 and disconnect the fuse module 104, the current path in the device 100 may be closed to once again complete the circuit path through the fuse module 104 by rotating the switch actuator 122 in the opposite direction indicated by arrow C in FIG. 2. As the switch actuator 122 rotates in the direction of arrow C, the actuator link 124 causes the sliding bar 126 to move linearly in the direction of arrow D and bring the switch contacts 130 and 128 toward the stationary contacts 134 and 116 to close the circuit path through the first and second line terminals 114 and 132. As such, by moving the actuator 122 to a desired position, the fuse module 104 and associated load side circuitry may be connected and disconnected from the line side circuitry while the line side circuitry remains "live" in an energized, full power condition. Alternatively stated, by rotating the switch actuator 122 to separate or join the switch contacts, the load side circuitry may be electrically isolated from the line side circuitry, or electrically connected to the line side circuitry on demand. While the switch actuator 122 and associated switching components is desirable in many applications, it is contemplated that the switch actuator 122 and related switching components may in some embodiments be considered optional and may be omitted.

Additionally, the fuse module 104 may be simply plugged into the fuse clips 110, 112 or extracted therefrom to install or remove the fuse module 104 from the disconnect housing 102. The fuse housing 106 projects from the disconnect housing 102 and is open and accessible from an exterior of the disconnect housing 102 so that a person simply can grasp the fuse housing 106 by hand and pull or lift the fuse module 104 in the direction of arrow B to disengage the fuse terminal blades 108 from the line and load side fuse clips 110 and 112 until the fuse module 104 is completely released from the disconnect housing 102. An open circuit is established between the line and load side fuse clips 110 and 112 when the terminal blades 108 of the fuse module 104 are removed as the fuse module 104 is released, and the circuit path between the fuse clips 110 and 112 is completed when the fuse terminal blades 108 are engaged in the fuse clips 110 and 112 when the fuse module 104 is installed. Thus, via insertion and removal of the fuse module 104, the circuit path through the device 100 can be opened or closed apart from the position of the switch contacts as described above.

Of course, the primary fuse element in the fuse module 104 provides still another mode of opening the current path through the device 100 when the fuse module is installed in response to actual current conditions flowing through the fuse element. As noted above, however, if the primary fuse element in the fuse module 104 opens, it does so permanently and the only way to restore the complete current path through the device 100 is to replace the fuse module 104 with another one having a non-opened fuse element. As such, and for discussion purposes, the opening of the fuse element in the fuse module 104 is permanent in the sense that the fuse module 100 cannot be reset to once again complete the current path through the device. Mere removal of the fuse module 104, and also displacement of the switch actuator 122 as described, are in contrast considered to be temporary events and are resettable to easily complete the current path and restore full operation of the affected circuitry by once again installing the fuse module 104 and/or closing the switch contacts.

The fuse module 104, or a replacement fuse module, can be conveniently and safely grasped by hand via the fuse module housing 106 and moved toward the switch housing 102 to engage the fuse terminal blades 108 to the line and load side fuse clips 110 and 112. The fuse terminal blades 108 are extendable through openings in the disconnect housing 102 to connect the fuse terminal blades 108 to the fuse clips 110 and 112. To remove the fuse module 104, the fuse module housing 106 can be grasped by hand and pulled from the disconnect housing 102 until the fuse module 104 is completely released. As such, the fuse module 104 having the terminal blades 108 may be rather simply and easily plugged into the disconnect housing 102 and the fuse clips 110, 112, or unplugged as desired.

Such plug-in connection and removal of the fuse module 104 advantageously facilitates quick and convenient installation and removal of the fuse module 104 without requiring separately supplied fuse carrier elements common to some conventional fusible disconnect devices. Further, plug-in connection and removal of the fuse module 104 does not require conventional tools (e.g., screwdrivers and wrenches) and associated fasteners (e.g., screws, nuts and bolts) common to other known fusible disconnect devices. Also, the fuse terminal blades 108 extend through and outwardly project from a common side of the fuse module body 106, and in the example shown the terminal blades 108 each extend outwardly from a lower side of the fuse housing 106 that faces the disconnect housing 102 as the fuse module 104 is mated to the disconnect housing 102.

In the exemplary embodiment shown, the fuse terminal blades 108 extending from the fuse module body 106 are generally aligned with one another and extend in respective spaced-apart parallel planes. It is recognized, however, that the terminal blades 108 of the module 106 in various other embodiments may be staggered or offset from one another, need not extend in parallel planes, and can be differently dimensioned or shaped. The shape, dimension, and relative orientation of the terminal blades 108, and the receiving fuse clips 110 and 112 in the disconnect housing 102 may serve as fuse rejection features that only allow compatible fuses to be used with the disconnect housing 102. In any event, because the terminal blades 108 project away from the lower side of the fuse housing 106, a person's hand when handling the fuse module housing 106 for plug in installation (or removal) is physically isolated from the terminal blades 108 and the conductive line and load side fuse clips 110 and 112 that receive the terminal blades 108 as mechanical and electrical connections therebetween are made and broken. The fuse module 104 is therefore touch safe (i.e., may be safely handled by hand to install and remove the fuse module 104 without risk of electrical shock).

The disconnect device 100 is rather compact and occupies a reduced amount of space in an electrical power distribution system including the line side circuitry and the load side circuitry than other known fusible disconnect devices and arrangements providing similar effect. In the embodiment illustrated in FIG. 2 the disconnect housing 102 is provided with a DIN rail slot 150 that may be used to securely mount the disconnect housing 102 in place with snap-on installation to a DIN rail by hand and without tools. The DIN rail may be located in a cabinet or supported by other structure, and because of the smaller size of the device 100, a greater number of devices 100 may be mounted to the DIN rail in comparison to conventional fusible disconnect devices.

In another embodiment, the device 100 may be configured for panel mounting by replacing the line side terminal 135, for example, with a panel mounting clip. When so provided, the device 100 can easily occupy less space in a fusible panelboard assembly, for example, than conventional in-line fuse and circuit breaker combinations. In particular, CUBE-Fuse™ power fuse modules occupy a smaller area, sometimes referred to as a footprint, in the panel assembly than non-rectangular fuses having comparable ratings and interruption capabilities. Reductions in the size of panelboards are therefore possible, with increased interruption capabilities.

In ordinary use of the exemplary device 100 as shown, the circuit path or current path through the device 100 is preferably connected and disconnected at the switch contacts 134, 130, 128, 116 rather than at the fuse clips 110 and 112. By doing so, electrical arcing that may occur when connecting/disconnecting the circuit path may be contained at a location away from the fuse clips 110 and 112 to provide additional safety for persons installing, removing, or replacing fuses. By opening the switch contacts with the switch actuator 122 before installing or removing the fuse module 104, any risk posed by electrical arcing or energized conductors at the fuse and disconnect housing interface is eliminated. The disconnect device 100 is accordingly believed to be safer to use than many known fused disconnect switches.

The disconnect switching device 100 includes still further features, however, that improve the safety of the device 100 in the event that a person attempts to remove the fuse module 104 without first operating the actuator 122 to disconnect the circuit through the fuse module 104, and also to ensure that the fuse module 104 is compatible with the remainder of the device 100. That is, features are provided to ensure that the rating of the fuse module 104 is compatible with the rating of the conductive components in the disconnect housing 102.

As shown in FIG. 2, the disconnect housing 102 in one example includes an open ended receptacle or cavity 152 on an upper edge thereof that accepts a portion of the fuse housing 106 when the fuse module 104 is installed with the fuse terminal blades 108 engaged to the fuse clips 110, 112. The receptacle 152 is shallow in the embodiment depicted, such that a relatively small portion of the fuse housing 106 is received when the terminal blades 108 are plugged into the disconnect housing 102. A remainder of the fuse housing 106, however, generally projects outwardly from the disconnect housing 102 allowing the fuse module housing 106 to be easily accessed and grasped with a user's hand and facilitating a finger safe handling of the fuse module 104 for installation and removal without requiring conventional tools. It is understood, however, that in other embodiments the fuse housing 106 need not project as greatly from the switch housing receptacle when installed as in the embodiment depicted, and indeed could even be substantially entirely contained within the switch housing 102 if desired.

In the exemplary embodiment shown in FIG. 2, the fuse housing 106 includes a recessed guide rim 154 having a slightly smaller outer perimeter than a remainder of the fuse housing 106, and the guide rim 154 is seated in the switch housing receptacle 152 when the fuse module 104 is installed. It is understood, however, that the guide rim 154 may be considered entirely optional in another embodiment and need not be provided. The guide rim 154 may in whole or in part serve as a fuse rejection feature that would prevent someone from installing a fuse module 104 having a rating that is incompatible with the conductive components in the disconnect housing 102. Fuse rejection features could further be provided by modifying the terminal blades 108 in shape, orientation, or relative position to ensure that a fuse module having an incompatible rating cannot be installed.

In contemplated embodiments, the base of the device 100 (i.e., the disconnect housing 102 and the conductive components therein) has a rating that is ½ of the rating of the fuse module 104. Thus, for example, a base having a current rating of 20 A may preferably be used with a fuse module 104 having a rating of 40 A. Ideally, however, fuse rejection features such as those described above would prevent a fuse module of a higher rating, such as 60 A, from being installed in the base. The fuse rejection features in the disconnect housing 102 and/or the fuse module 104 can be strategically coordinated to allow a fuse of a lower rating (e.g., a fuse module having a current rating of 20 A) to be installed, but to reject fuses having higher current ratings (e.g., 60 A and above in the example being discussed). It can therefore be practically ensured that problematic combinations of fuse modules and bases will not occur. While exemplary ratings are discussed above, they are provided for the sake of illustration rather than limitation. A variety of fuse ratings and base ratings are possible, and the base rating and the fuse module rating may vary in different embodiments and in some embodiments the base rating and the fuse module rating may be the same.

As a further enhancement, the disconnect housing 102 includes an interlock element 156 that frustrates any effort to remove the fuse module 104 while the circuit path through the first and second line terminals 132 and 114 via the switch contacts 134, 130, 128, 116 is closed. The exemplary interlock element 156 shown includes an interlock shaft 158 at a leading edge thereof, and in the locked position shown in FIG. 2 the interlock shaft 158 extends through a hole in the first fuse terminal blade 108 that is received in the line side fuse clip 110. Thus, as long as the projecting interlock shaft 158 is extended through the opening in the terminal blade 108, the fuse module 104 cannot be pulled from the fuse clip 110 if a person attempts to pull or lift the fuse module housing 106 in the direction of arrow B. As a result, and because of the interlock element 156, the fuse terminal blades 108 cannot be removed from the fuse clips 110 and 112 while the switch contacts 128, 130 are closed and potential electrical arcing at the interface of the fuse clips 110 and 112 and the fuse terminal blades 108 is avoided. Such an interlock element 156 is believed to be beneficial for the reasons stated but could be considered optional in certain embodiments and need not be utilized.

The interlock element 156 is coordinated with the switch actuator 122 so that the interlock element 156 is moved to an unlocked position wherein the first fuse terminal blade 108 is released for removal from the fuse clip 110 as the switch actuator 122 is manipulated to open the device 100. More specifically, a pivotally mounted actuator arm 160 is provided in the disconnect housing 102 at a distance from the switch actuator 122, and a first generally linear mechanical link 162 interconnects the switch actuator 122 with the arm 160. The pivot points of the switch actuator 122 and the arm 160 are nearly aligned in the example shown in FIG. 1, and as the switch actuator 122 is rotated in the direction of arrow A, the link 162 carried on the switch actuator 122 simultaneously rotates and causes the arm 160 to rotate similarly in the direction of arrow E. As such, the switch actuator 122 and the arm 160 are rotated in the same rotational direction at approximately the same rate.

A second generally linear mechanical link 164 is also provided that interconnects the pivot arm 160 and a portion of the interlock element 156. As the arm 160 is rotated in the direction of arrow E, the link 164 is simultaneously displaced and pulls the interlock element 156 in the direction of arrow F, causing the projecting shaft 158 to become disengaged from the first terminal blade 108 and unlocking the interlock element 156. When so unlocked, the fuse module 104 can then be freely removed from the fuse clips 110 and 112 by lifting on the fuse module housing 106 in the direction of arrow B. The fuse module 104, or perhaps a replacement fuse module 104, can accordingly be freely installed by plugging the terminal blades 108 into the respective fuse clips 110 and 112.

As the switch actuator 122 is moved back in the direction of arrow C to close the disconnect device 100, the first link 162 causes the pivot arm 160 to rotate in the direction of arrow G, causing the second link 164 to push the interlock element 156 in the direction of arrow H until the projecting shaft 158 of the interlock element 156 again passes through the opening of the first terminal blade 108 and assumes a locked position with the first terminal blade 108. As such, and because of the arrangement of the arm 160 and the links 162 and 164, the interlock element 156 is slidably movable within the disconnect housing 102 between locked and unlocked positions. This slidable movement of the interlock element 156 occurs in a substantially linear and axial direction within the disconnect housing 102 in the directions of arrow F and H in FIG. 1.

In the example shown, the axial sliding movement of the interlock element 156 is generally perpendicular to the axial sliding movement of the actuator bar 126 that carries the switchable contacts 128 and 130. In the plane of FIG. 2, the movement of the interlock element 156 occurs along a substantially horizontal axis, while the movement of the sliding bar 126 occurs along a substantially vertical axis. The vertical and horizontal actuation of the sliding bar 126 and the interlock element 156, respectively, contributes to the compact size of the resultant device 100, although it is contemplated that other arrangements are possible and could be utilized to mechanically move and coordinate positions of the switch actuator 122, the switch sliding bar 126 and the interlock element 156. Also, the interlock element 156 may be biased to assist in moving the interlock element 156 to the locked or unlocked position as desired, as well as to resist movement of the switch actuator 122, the sliding bar 126 and the interlock element 156 from one position to another. For example, by biasing the switch actuator 122 to the opened position to separate the switch contacts, either directly or indirectly via bias elements acting upon the sliding bar 126 or the interlock element 156, inadvertent closure of the switch actuator 122 to close the switch contacts and complete the current path may be largely, if not entirely frustrated, because once the switch contacts are opened a person must apply a sufficient force to overcome the bias force and move the switch actuator 122 back to the closed position shown in FIG. 2 to reset the device 100 and again complete the circuit path. If sufficient bias force is present, it can be practically ensured that the switch actuator 122 will not be moved to close the switch via accidental or inadvertent touching of the switch actuator 122.

The interlock element 156 may be fabricated from a nonconductive material such as plastic according to known techniques, and may be formed into various shapes, including but not limited to the shape depicted in FIG. 2. Rails and the like may be formed in the disconnect housing 102 to facilitate the sliding movement of the interlock element 156 between the locked and unlocked positions.

The pivot arm 160 is further coordinated with a tripping element 170 for automatic operation of the device 100 to open the switch contacts 128, 130. That is, the pivot arm 160, in combination a tripping element actuator described below, and also in combination with the linkage 124, 162, and 164 define a tripping mechanism to force the switch contacts 128, 130 to open independently from the action of any person. Operation of the tripping mechanism is fully automatic, as described below, in response to actual circuit conditions, as opposed to the manual operation of the switch actuator 122 described above. Further, the tripping mechanism is multifunctional as described below to not only open the switch contacts, but to also to displace the switch actuator 122 and the interlock element 156 to their opened and unlocked positions, respectively. The pivot arm 160 and associated linkage may be fabricated from relatively lightweight nonconductive materials such as plastic.

In the example shown in FIG. 2, the tripping element actuator 170 is an electromagnetic coil such as a solenoid having a cylinder or pin 172, sometimes referred to as a plunger, that is extendable or retractable in the direction of arrow F and H along an axis of the coil. The coil when energized generates a magnetic field that causes the cylinder or pin 172 to be displaced. The direction of the displacement depends on the orientation of the magnetic field generated so as to push or pull the plunger cylinder or pin 172 along the axis of the coil. The plunger cylinder or pin 172 may assume various shapes (e.g., may be rounded, rectangular or have other geometric shape in outer profile) and may be dimensioned to perform as hereinafter described.

In the example shown in FIG. 2, when the plunger cylinder or pin 172 is extended in the direction of arrow F, it mechanically contacts a portion of the pivot arm 160 and causes rotation thereof in the direction of arrow E. As the pivot arm 160 rotates, the link 162 is simultaneously moved and causes the switch actuator 122 to rotate in the direction of arrow A, which in turn pulls the link 124 and moves the sliding bar 126 to open the switch contacts 128, 130. Likewise, rotation of the pivot arm 160 in the direction of arrow E simultaneously causes the link 164 to move the interlock element 156 in the direction of arrow F to the unlocked position.

It is therefore seen that a single pivot arm 160 and the linkage 162 and 164 mechanically couples the switch actuator 122 and the interlock element 156 during normal operation of the device, and also mechanically couples the switch actuator 122 and the interlock element 156 to the tripping element 170 for automatic operation of the device. In the exemplary embodiment shown, an end of the link 124 connecting the switch actuator 122 and the sliding bar 126 that carries the switch contacts 128, 130 is coupled to the switch actuator 122 at approximately a common location as the end of the link 162, thereby ensuring that when the tripping element 170 operates to pivot the arm 160, the link 162 provides a dynamic force to the switch actuator 122 and the link 124 to ensure an efficient separation of the contacts 128 and 130 with a reduced amount of mechanical force than may otherwise be necessary. The tripping element actuator 170 engages the pivot arm 160 at a good distance from the pivot point of the arm 160 when mounted, and the resultant mechanical leverage provides sufficient mechanical force to overcome the static equilibrium of the mechanism when the switch contacts are in the opened or closed position. A compact and economical, yet highly effective tripping mechanism is therefore provided. Once the tripping mechanism operates, it may be quickly and easily reset by moving the switch actuator 122 back to the closed position that closes the switch contacts.

Suitable solenoids are commercially available for use as the tripping actuator element 170. Exemplary solenoids include LEDEX® Box Frame Solenoid Size B17M of Johnson Electric Group (www.ledex.com) and ZHO-0520L/S Open Frame Solenoids of Zohnen Electric Appliances (www.zonhen.com). In different embodiments, the solenoid 170 may be configured to push the arm 160 and cause it to rotate, or to pull the contact arm 160 and cause it to rotate. That is, the tripping mechanism can be operated to cause the switch contacts to open with a pushing action on the pivot arm 160 as described above, or with a pulling action on the pivot arm 160. Likewise, the solenoid could operate on elements other than the pivot arm 160 if desired, and more than one solenoid could be provided to achieve different effects.

In still other embodiments, it is contemplated that actuator elements other than a solenoid may suitably serve as a tripping element actuator to achieve similar effects with the same or different mechanical linkage to provide comparable tripping mechanisms with similar benefits to varying degrees. Further, while simultaneous actuation of the components described is beneficial, simultaneous activation of the interlock element 156 and the sliding bar 126 carrying the switch contacts 128, 130 may be considered optional in some embodiments and these components could accordingly be independently actuated and separately operable if desired. Different types of actuator could be provided for different elements.

Moreover, in the embodiment shown the trip mechanism is entirely contained within the disconnect housing 102 while still providing a relatively small package size. It is recognized, however, that in other embodiments the tripping mechanism may in whole or in part reside outside the disconnect housing 102, such as in separately provided modules that may be joined to the disconnect housing 102. As such, in some embodiments, the trip mechanism could be, at least in part, considered an optional add-on feature provided in a module to be used with the disconnect housing 102. Specifically, the trip element actuator and linkage in a separately provided module may be mechanically linked to the switch actuator 122, the pivot arm 160 and/or the sliding bar 126 of the disconnect housing 102 to provide comparable functionality to that described above, albeit at greater cost and with a larger overall package size.

The tripping element 170 and associated mechanism may further be coordinated with a detection element and control circuitry to automatically move the switch contacts 128, 130 to the opened position when predetermined electrical conditions occur. In one exemplary embodiment, the second line terminal 132 is provided with an in-line detection element 180 that is monitored by control circuitry 190. As such, actual electrical conditions can be detected and monitored in real time and the tripping element 170 can be intelligently operated to open the circuit path in a proactive manner independent of operation of the fuse module 104 itself and/or any manual displacement of the switch actuator 122. That is, by sensing, detecting and monitoring electrical conditions in the line terminal 132 with the detection element 180, the switch contacts 128, 130 can be automatically opened with the tripping element 170 in response to predetermined electrical conditions that are potentially problematic for either of the fuse module 104 or the base assembly (i.e., the disconnect housing 102 and its components).

In particular, the control circuitry 190 may open the switch contacts in response to conditions that may otherwise, if allowed to continue, cause the primary fuse element in the fuse module 104 to permanently open and interrupt the electrical circuit path between the fuse terminals 108. Such monitoring and control may effectively prevent the fuse module 104 from opening altogether in certain conditions, and accordingly save it from having to be replaced, as well as providing notification to electrical system operators of potential problems in the electrical power distribution system. Beneficially, if permanent opening of the fuse is avoided via proactive management of the tripping mechanism, the device 100 becomes, for practical purposes, a generally resettable device that may in many instances avoid any need to locate a replacement fuse module, which may or may not be readily available if needed, and allow a much quicker restoration of the circuitry than may otherwise be possible if the fuse module 104 has to be replaced. It is recognized, however, that if certain circuit conditions were to occur, permanent opening of the fuse 104 may be unavoidable.

While the device 100 has delivered enhanced fusible switch disconnect features in a reduced package size, it remains limited in some aspects and for certain power systems. As previously mentioned, higher voltage, higher current power systems provide dramatically increased arc energy potential that must be safely contained in the device 100. A potential solution to accommodating the arc energy of higher current, higher voltage DC power systems would be to increase the size and strength of the component parts of the disconnect device. While this could be accomplished, and in the past has been the approach adopted in the field, it undesirably increases the size and cost of the fusible disconnect device. Maintaining the physical package size of existing devices while offering improved capability to function in higher power electrical systems and/or reducing the size of existing devices with the same or enhanced improved capability to function in higher power electrical systems while also providing cost reduction remains somewhat of an elusive goal to manufacturers of fusible switch disconnect devices.

Considering the needs of high energy DC power systems, opportunities to improve devices such as the device 100 in a similar or reduced package size reside primarily in limiting arc severity and arc duration to a more manageable amount inside the device. In this regard, a limitation of known fusible switch disconnect devices has been found to reside in the switch mechanisms utilized. Slower acting switches provide more time for arcing to occur (i.e., increase a length of arcing duration as the switch is opened and closed), and switch contacts moving a smaller distance tend to break arcs less effectively than switch contacts that move a larger distance.

Improvements which may be incorporated in the devices 80 and the array 50 as described above to offer enhanced DC power system performance relative to the device 100 described above, will now be explained in relation to FIGS. 3-18. Like elements of the device 100 and like elements of the following embodiments are therefore indicated with like reference characters. It is to be understood, however, that the inventive embodiments and switch mechanisms described below do not necessarily require all of the particulars of the device 100 described and/or do not require the particulars of the fuse 104 for implementation. That is, some of the features described above in relation to the device 100 may be considered optional and may be omitted, while still achieving at least some of the benefits of the present invention. The device 100 and fuse 104 are therefore non-limiting comparative examples of the type of fusible switching disconnect device and fuse that would benefit from the improvements described below. Other types of fusible switching disconnect devices for fuses other than fuses having plug-in terminal blades, including but not limited to so-called cylindrical or cartridge fuses, may also benefit from the concepts disclosed herein and accordingly the embodiments described herein are offered for the sake of illustration rather than limitation. Method aspects will be in part apparent and in part explicitly discussed from the following description.

Figure 3:
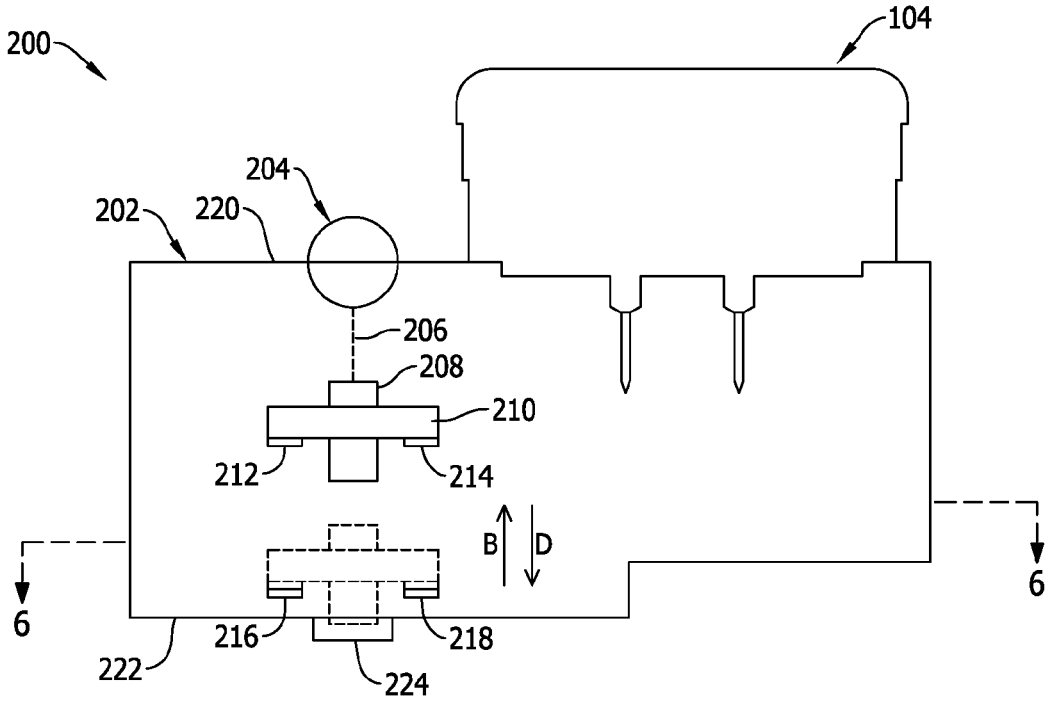
FIG. 3 is a partial illustration of an exemplary fusible switch disconnect switch of the invention.

FIG. 3 illustrates a fusible switch disconnect device 200 that may be used as the device 80 in the array 50 shown in FIG. 1 with further benefits. The switch disconnect device 200 includes a switch disconnect housing 202 and terminal structure (not shown) similar to that described in relation to the fusible switch disconnect device 100 that receives a fuse such as the fuse 104 and establishes an electrical connection through the fuse 104.

Like the fusible switch disconnect device 100, the fusible switch disconnect 200 includes a rotary switch actuator 204 projecting upwardly and outwardly from a portion of the switch disconnect housing 202. Linkage 206 such as the exemplary linkages described below in relation to FIGS. 7-18 is provided to mechanically connect the rotary switch actuator 204 and a slider bar 208 that is movable along a linear axis in the switch disconnect housing 202. The slider bar 208 includes a transverse switch contact bar element 210 that carries movable switch contacts 212, 214 in the housing 202. The linkage 206, driven by the actuator 204, selectively positions the movable contacts 212, 214 along the linear axis toward and away from stationary contacts 216, 218 that are fixed in position within the switch housing 202.

The switch housing 202 is formed in the example shown with a top surface 220 from which the switch actuator 204 projects, and a bottom surface 222 opposing the top surface 220. The stationary contacts 216, 218 are seen to be positioned adjacent the bottom surface 222, allowing the slider bar 208 and contact element 210 to move a greater distance than in an embodiment like the device 100 shown in FIG. 2 wherein the stationary contacts 116, 134 are located at a distance from bottom of the housing 102. As such, even if the housing 202 has a comparable size to the housing 102 of the device 100 in the vertical direction of the figures as illustrated, the device 200 can more effectively handle increased arc energy presented by a DC electrical power system. Comparatively, the movable switch contacts 212, 214 traverse a longer path along the linear axis in the direction of arrow B or D between a fully opened position (shown in solid lines in FIG. 3) and a fully closed position (shown in phantom in FIG. 3) wherein mechanical and electrical contact between the switch contacts 212, 216 and 214, 218 is made and broken. The larger path of travel, in turn, produces a larger gap between the contacts when fully opened. The gap length when the contacts are fully opened may be selected to be sufficiently large to overcome any tendency of an electrical arc to sustain itself across the gap as the switch contacts 212, 214 are opened.

As shown in example of FIG. 3, the housing bottom surface 222 further includes a pocket or recess 224 extending from the bottom surface 222. The pocket or recess 224 receives and accommodates a portion of the slider bar 208 when the switch contacts are fully closed and facilitates the increased path length of travel for the switch contacts 212, 214 when the switch contacts are closed. The pocket or recess 224 further includes a bias element seat 226 (FIG. 6) for a bias element such as a compression spring that assists with opening of the switch contacts. The pocket or recess 224 projects from the bottom surface 222 as shown, and hence enlarges the outer dimension of the device 200 somewhat, but advantageously maximizes the contact gap separation on the inside of the housing 202 when the switch is opened.

Figure 4:
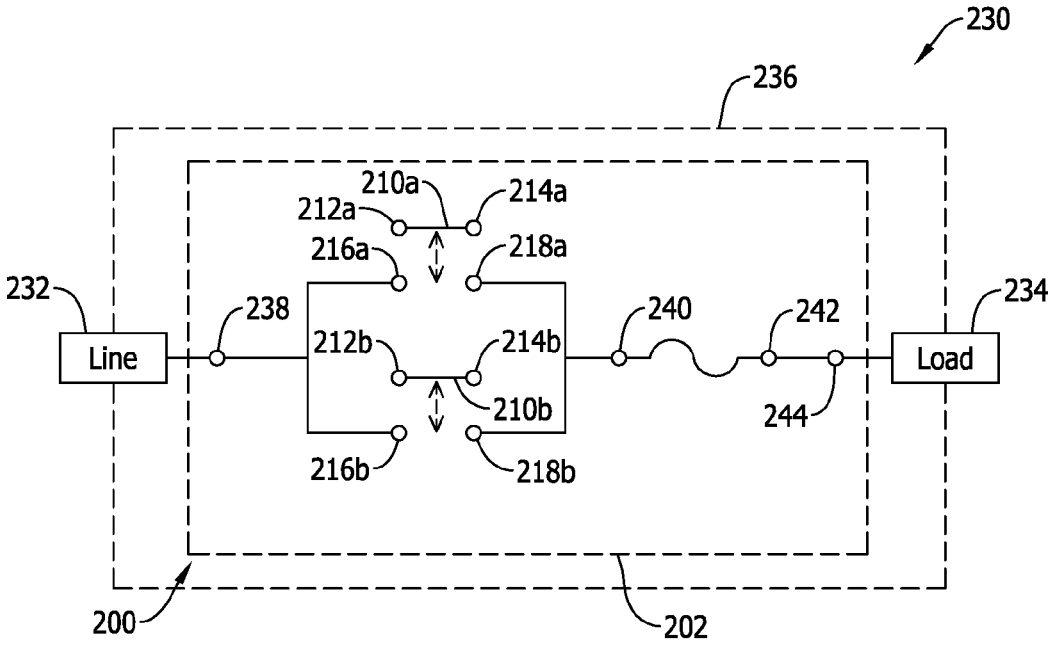
FIG. 4 is a schematic of the exemplary fusible switch disconnect switch shown in FIG. 3 in an electrical power system.

FIG. 4 schematically illustrates a DC electrical power system 230 for supplying electrical power from a power supply or line-side circuitry 232 to power receiving or load-side circuitry 234. In contemplated embodiments the line-side circuitry 232 and load-side circuitry 234 may be associated with a panelboard 236 that includes a fusible switching disconnect device 200 either singly or in an array such as the array 50 illustrated in FIG. 1. While one fusible switching disconnect device 200 is shown, it is contemplated that in a typical installation a plurality of fusible switching disconnect devices 200 would be provided in the panel board 236 that each respectively receives input power from the line-side circuitry 232 via, for example, a bus bar (not shown), and outputs electrical power to one or more of various different electrical loads 234 associated with branch circuits of the larger electrical power system 230. As such, an array of devices 200 may be provided on the panelboard 236.

The fusible switching disconnect device 200 may be configured as a compact fusible switching disconnect device such as those described above and further below that advantageously combine switching capability and enhanced fusible circuit protection in a single, compact switch housing 202. As shown in FIG. 4, the fusible switching disconnect device 200 defines a circuit path through the switch housing 202 between the line-side circuitry 232 and the load-side circuitry 234.

Figure 5:
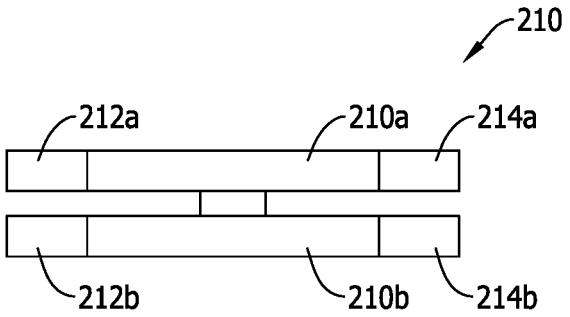
FIG. 5 a bottom view of a dual bar switch contact element for the fusible switch disconnect switch shown in FIG. 3.
Figure 6:
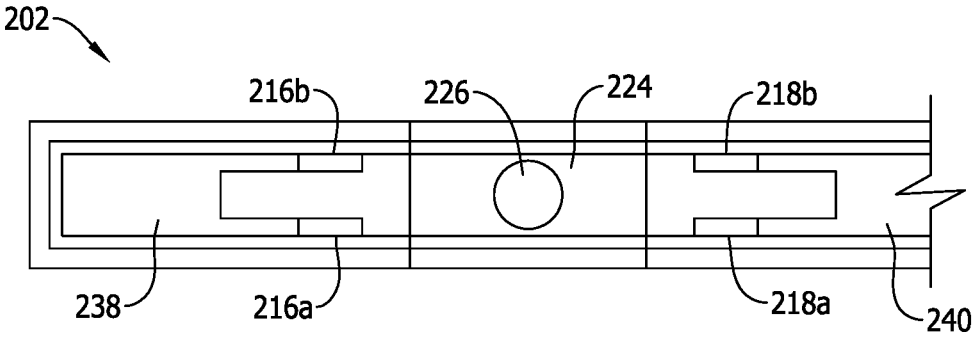
FIG. 6 is a partial sectional view of a portion of the fusible switch disconnect device shown in FIG. 3 taken alone line 6-6.

As shown in FIG. 5, the contact element 210 includes dual contact bars 210*a* and 210*b* that are spaced apart and oriented generally parallel to one another. Each contact bar 210*a*, 210*b* respectively includes switch contacts 212*a*, 212*b* and 214*a*, 214*b* on their respective opposing ends. The switch contacts 212*a*, 212*b* and 214*a*, 214*b* move with the contact element bars 210*a*, 210*b* and engage or disengage the stationary switch contacts 216*a*, 216*b*, 218*a*, 218*b* located adjacent the bottom of the switch housing 202 as shown in FIG. 6. The stationary switch contacts 216*a*, 216*b* are located on one side of the pocket or recess 224 and the stationary contacts 218*a*, 218*b* are located on an opposing side of the pocket or recess 224 at the bottom of the housing 202. As such, the contacts 216*a*, 216*b* provide a first set of switch contacts on the line-side, and the contacts 218*a*, 218*b* provide a second set of switch contacts on the load-side that, in turn, connects to the fuse 104. The movable contacts 212*a*, 212*b* and 214*a*, 214*b* are engaged or disengaged to open and close the switch and complete or break the connection of the fuse 104 and the line-side circuitry.

Compared to the device 100 shown in FIG. 2 having two movable contacts, the dual pairs of switch contacts 212*a*, 212*b* and 214*a*, 214*b* on the contact element 210 and the dual pairs of switch contacts 216*a*, 216*b* and 218*a*, 218*b* in the switch housing 202, the device 200 can provide much more effective breaking of electrical arcs than the device 100 as the contacts are opened and closed. Specifically, in the device 200 arc energy is broken at the respective locations of four pairs of contacts instead of two, and arc division occurs at those four locations instead of two, resulting in less severe arcing at each location. Relative to conventional fusible switching disconnect devices, the increased number of switch contacts decreases operating temperature of the switch contacts when switched under high current loads. Coupled with the larger contact gap separation as described above, the increased number of switch contacts in the device 200 may either dissipate arcing energy much more easily than the device 100 for comparable voltages and currents that are being switched, or accommodate higher current and higher voltage switching that are beyond the capabilities of the device 100.

Returning now to FIG. 4, the circuit path of the fusible switching disconnect device 200 includes, as shown in FIG. 4, a line-side connecting terminal 238 and the movable switchable contacts 212*a*, 212*b*, 214*a*, 214*b* (carried on the contact bar element 210 and the dual bars 210*a*, 210*b* as shown in FIG. 5) and stationary switch contacts 216*a*, 216*b* associated with the line-side terminal connecting terminal 238, stationary contacts 218*a*, 218*b* associated with a first fuse contact terminal 240, and a second fuse contact terminal 242. The removable overcurrent protection fuse 104 is connected between the fuse contact terminals 240 and 242, and a load-side connecting terminal 244 completes the current path. Each of the elements 238, 212, 214, 216, 218, 240, 242 and 244 that define a portion of the circuit path are included in the housing 202 while the overcurrent protection fuse 104 is separately provided but used in combination with the housing 202 and the conductive elements 238, 212, 214, 216, 218, 240, 242 and 244 in the switch housing 202.

The switch contacts 212*a*, 212*b*, 214*a*, 214*b* are movable relative to the stationary switch contacts 216*a*, 216*b*, 218*a*, 218*b* between opened and closed positions to electrically connect or isolate the line-side connecting terminal 238 and the fuse contact terminal 240 and hence connect or disconnect the load-side circuitry 234 from the line-side circuitry 232 when desired. When the fusible switching disconnect device 200 is connected to energized line-side circuitry 232, and also when the switch contacts 212*a*, 212*b*, 214*a*, 214*b* are closed as shown in phantom in FIG. 3 and the fuse 104 is intact, electrical current flows through the line-side connecting terminal 238 of the fusible switching disconnect device 200 and through the switchable contacts 212*a*, 212*b*, 214*a*, 214*b* and 216*a*, 216*b*, 218*a*, 218*b*, to and through the fuse contact terminal 240 and the fuse 104 to the fuse contact terminal 242, and to and through the load-side connecting terminal 244 to the load. When the switch contacts 212*a*, 212*b*, 214*a*, 214*b* are opened, an open circuit is established between the contact 216*a*, 216*b*, 218*a*, 218*b* in the switch housing 202 of the fusible switching disconnect device 200 and the load-side circuitry 234 is electrically isolated or disconnected from the line-side circuitry 232 via the fusible switching disconnect device 200. When the contacts 212*a*, 212*b*, 214*a*, 214*b* are again closed, electrical current flow resumes through the current path in the fusible switching disconnect device 200 and the load-side circuitry 234 is again connected to the line-side circuitry 232 through the fusible switching disconnect device 200.

When the overcurrent protection fuse 104 is subjected to a predetermined electrical current condition when the switch contacts 212*a*, 212*b*, 214*a*, 214*b* and 216*a*, 216*b*, 218*a*, 218*b* are closed, however, the overcurrent protection fuse 104, and specifically the fusible element (or fusible elements) therein is configured to permanently open or fail to conduct current any longer, creating an open circuit between the fuse contact terminals 240 and 242. When the overcurrent protection fuse 104 opens in such a manner, current flow through the fusible switching disconnect device 200 is interrupted and possible damage to the line-side circuitry 232 is avoided. In one contemplated embodiment, the fuse 104 may be a rectangular fuse module such as a CUBE-Fuse™ power fuse module commercially available from Bussmann by Eaton of St. Louis, Mo. In other embodiments, the overcurrent protection fuse 104 may be a cylindrical fuse such as a Class CC fuse, a so-called Midget fuse, or an IEC 10×38 fuse also available from Bussmann by Eaton.

Because the overcurrent protection fuse 104 permanently opens, the overcurrent protection fuse 104 must be replaced to once again complete the current path between the fuse contact terminals 240 and 242 in the fusible switching disconnect device 200 such the power can again be supplied to the load-side circuitry 234 via the fusible switching disconnect device 200. In this aspect, the fusible switching disconnect device 200 is contrasted with a circuit breaker device that is known to provide overcurrent protection via a resettable breaker element. At least in part because the device 200 does not involve or include a resettable circuit breaker element in the circuit path completed in the switch housing 202, the fusible switching disconnect device 200 is considerably smaller than an equivalently rated circuit breaker device providing similar overcurrent protection performance.

As compared to conventional arrangements wherein fusible devices are connected in series with separately packaged switching elements, the fusible switching disconnect device 200 is relatively compact and can provide substantial reduction in size and cost while providing comparable, if not superior, circuit protection performance.

When the compact fusible switching disconnect devices 200 are utilized in combination in a panelboard 236, current interruption ratings of the panelboard 236 may be increased while the size of the panelboard 236 may be simultaneously reduced. The compact fusible disconnect device 200 may advantageously accommodate fuses 104 without involving a separately provided fuse holder or fuse carrier that is found in certain types of conventional fusible switch disconnect devices. The compact fusible disconnect device 200 may also be configured to establish electrical connection to the fuse contact terminals 240, 242 without fastening of the fuse 104 to the line and load-side terminals with separate fasteners, and therefore provide still further benefits by eliminating certain components of conventional fusible disconnect constructions while simultaneously providing a lower cost, yet easier to use fusible circuit protection product 200.

Figure 7:
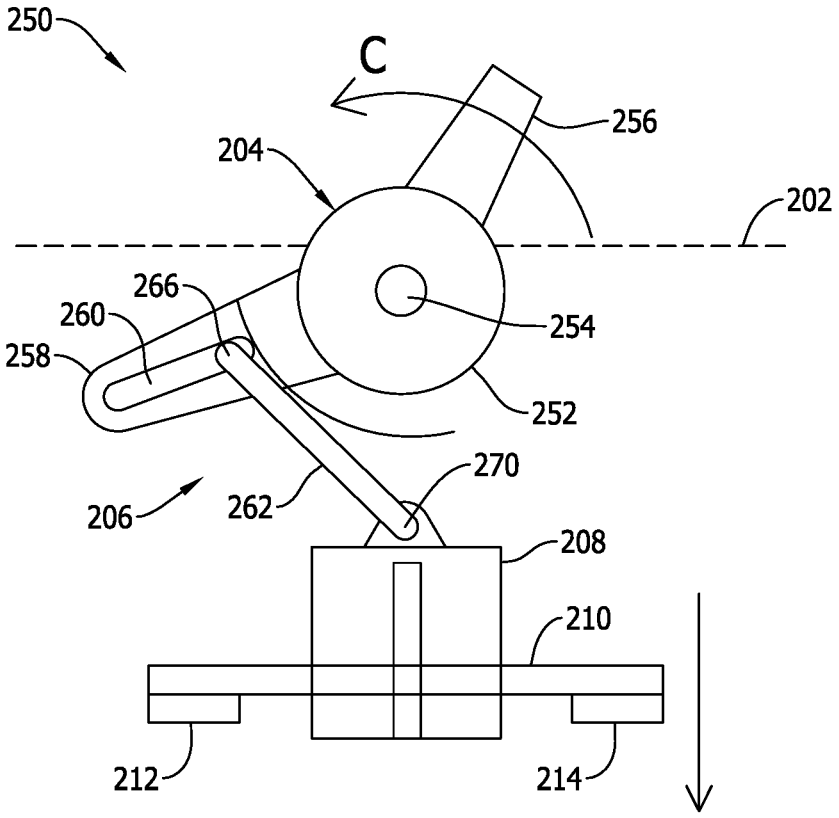
FIG. 7 is a partial illustration of an exemplary linear cam switch mechanism arrangement for a fusible switch disconnect switch according to the invention.
Figure 8:
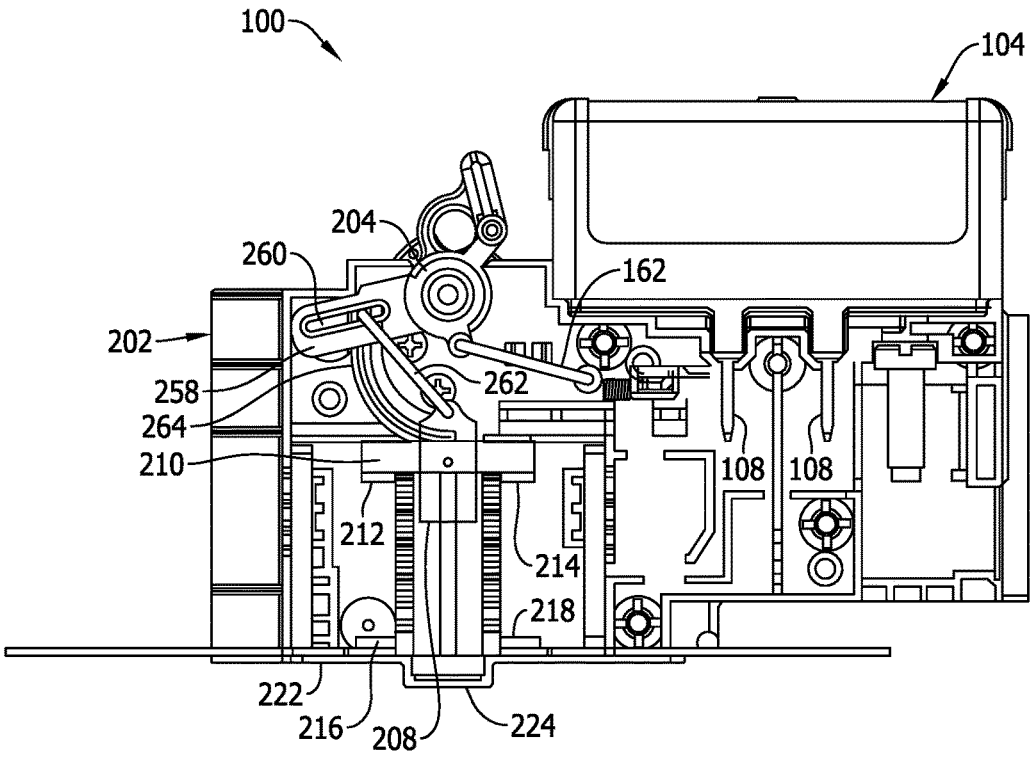
FIG. 8 illustrates the linear cam switch mechanism arrangement of FIG. 7 installed in a switch disconnect device and in an open position.
Figure 9:
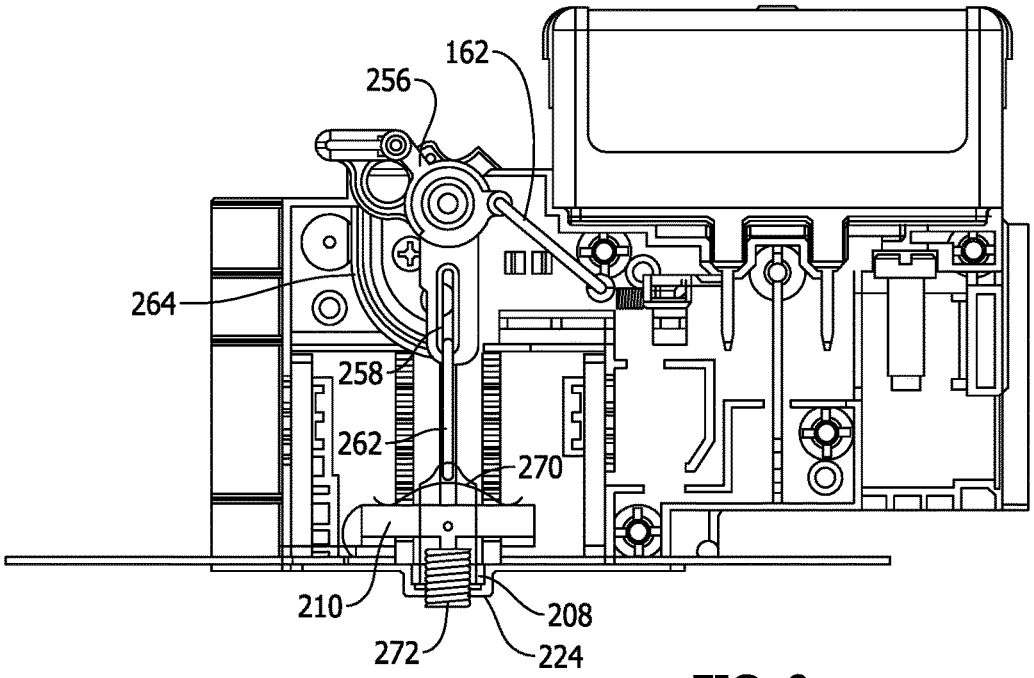
FIG. 9 illustrates the linear cam switch mechanism arrangement of FIG. 7 installed in a switch disconnect device and in a closed open position.

FIG. 7 illustrates a first improved switch mechanism 250 that may be included in the device 200. FIGS. 8 and 9 illustrate more detailed implementations of the switch mechanism 250. The switch mechanism 250 includes the rotary switch actuator 204 having a round body 252 that is rotatably mounted in the switch housing 202 about a center pin or axle 254. The actuator 204 is formed with a radially extending handle portion 256 that projects from the switch housing 202 when installed, and an elongate link guide member 258 also depends radially from the round body 204 at an oblique angle from the handle portion 256. The elongate link guide member 258 includes an elongated and generally linearly extending slot 260 therein and extending radially from the round body 252 of the actuator 204.

An actuator link or rod 262 is received in the slot 260 and also in a cam surface 264 (FIGS. 8 and 9) via a first end 266 that is bent at a right angle from the longitudinal axis of the link 262. At a second end 270 of the link 262 opposing the first end 266, the link 262 is rotatably mounted to the distal end of the sliding bar 208. The link 262 is generally linear between the two ends 266, 270 and has a length selected, as discussed below, to achieve a desired contact separation of the switch mechanism when opened.

The end 266 of the link 262 may rotate and translate relative to the guide member 258 as it traverses the slot 260 in use, while the end 270 of the link 262 is rotatable, but not translatable, relative to the slider bar 208. In this context, translatable motion of the link end 266 refers to the ability of the link 266 to move closer to or farther away from the axis of rotation of the actuator body 252. In contrast, the end 270 of the link 262 is pinned to the end of the sliding 208 bar and its position along the sliding linear axis is dictated by the sliding bar 208. While the link end 270 can rotate or pivot relative to the slider bar 208, it is incapable of translation movement relative to the slider bar 208.

In FIGS. 7 and 8, the switch mechanism 250 is shown in the open position. The link 262 is accordingly shown in the open position as extending obliquely to the contact element 210 and also to the linear axis of motion of the slider bar 208. By rotating the actuator body 204 in the direction of arrow C, the end 266 of the link 262 is constrained by the slot 260 and the cam surface 264 while the end 270 drives the slider bar 208 and its switch contacts 212, 214 toward the switch contacts 216 and 218. When fully closed as shown in FIG. 9, the link 262 is oriented generally vertically and assumes a generally perpendicular orientation to the contact element 210 to provide maximum contact force. Alternatively stated, in the closed position the link 262 is generally aligned with the linear axis of the slider bar 208 and maximum contact force is therefore established. The switch actuator 204 can be rotated in the opposite direction to return the mechanism to the open position. The switch mechanism operates in reverse as it is opened and closed with the actuator 204.

As shown in FIG. 9 counteracting bias elements such as a leaf spring 270 and a compression spring 272 act on opposing sides of the contact element 210. The leaf spring 270 (shown separately in FIG. 10) provides enhanced contact closing force, while the compression spring 272 provides for enhanced contact opening force. It is understood that in other embodiments, other biasing arrangements are possible, including but not limited to a tension spring in lieu of a compression spring in combination with bias elements other than a leaf spring.

Figure 10:
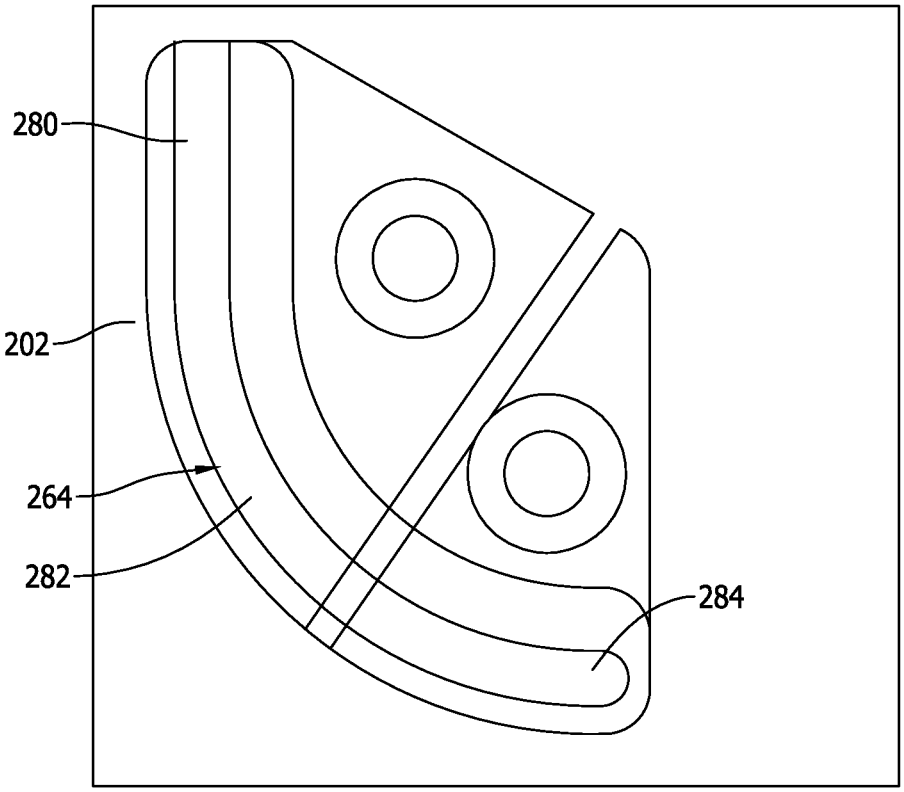
FIG. 10 illustrates a first exemplary cam profile for the linear cam switch mechanism arrangement of FIG. 7.

FIG. 10 illustrates an exemplary cam profile for the cam surface 264. The cam profile is seen to include a linearly extending portion 280 that extends generally vertically or parallel to the vertical axis of movement of the slider bar 208. The linearly extending portion 280 opens to an arcuate portion 282 that completes a substantially 90° arcuate path culminating in a generally horizontally extending portion 284. With the illustrated cam profile, the slider bar 208 is accelerated toward to the stationary contacts as the actual link 262 traverses the cam surface 264 and reduces arcing time as the contact are closed. That is, the velocity of the slider bar 208 as the cam surface 264 is followed is non-uniform to achieve a quicker reduction of the contact gap in first phase of contact closing and slower movement of the slider bar 208 as the contact closing is near completion. Quicker opening or closing of the contacts either breaks or suppresses arcing of a given potential more easily, or provides capability of breaking and suppressing higher intensity arcs than a comparable device without such a cam profile.

Figure 11:
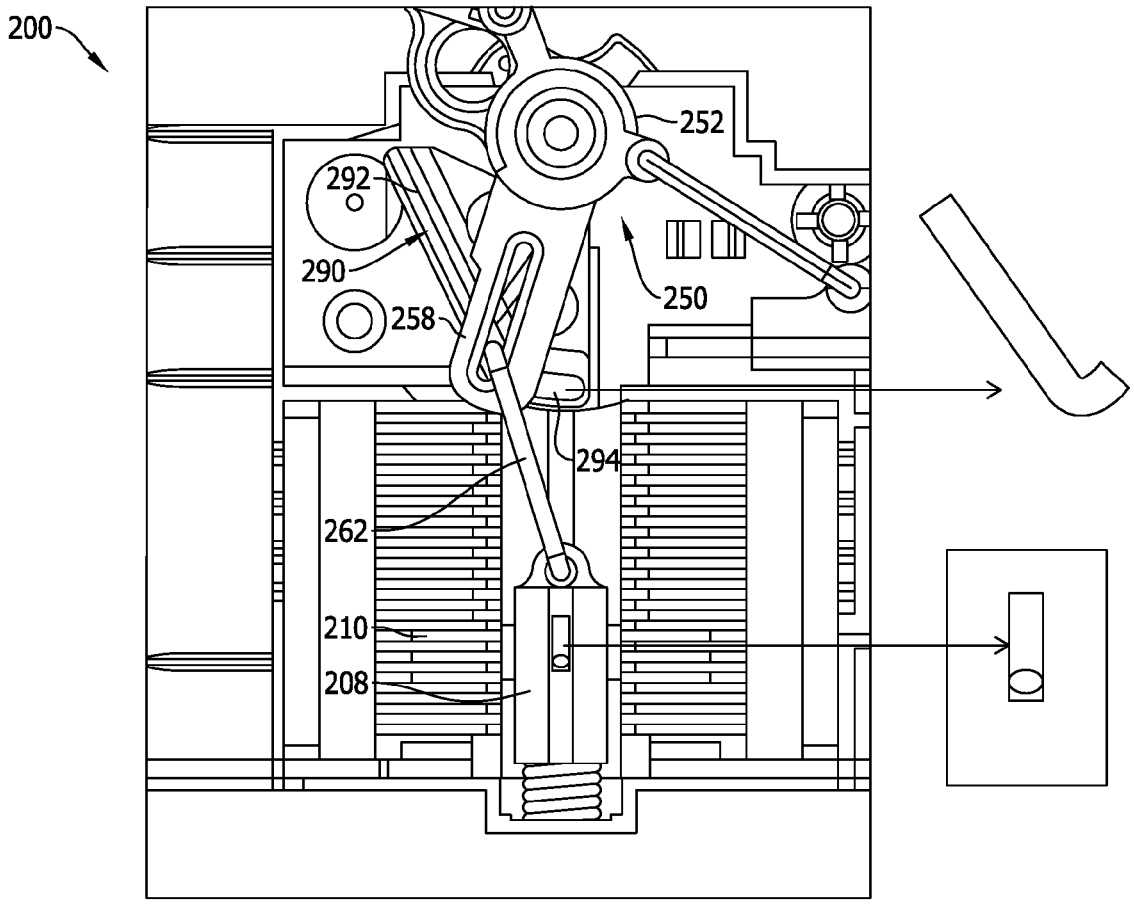
FIG. 11 illustrates a second exemplary cam profile for the linear cam switch mechanism arrangement of FIG. 7.

FIG. 11 illustrates an alternative cam surface 290 for the device 200 and the switch mechanism 250. The cam surface 290 has a profile that includes an elongated and linear extending oblique portion 292 that extends obliquely to the to the vertical axis of movement of the slider bar 208, and an end section 294 that is arcuate. The end section 294 is designed to reach maximum downward displacement of the link 262 at its end 270 about 5° before dead end and then lift the end 270 as it approaches the dead end of the cam surface 290. Advantageously, this cam profile over-compresses the contacts as the mechanism is closed, and then retracts the contacts to produce the desired contact force. The end 270 of the cam profile provides a detent feature that reliably keeps the switch closed in a stable position counteracted by the features described above.

Figure 12:
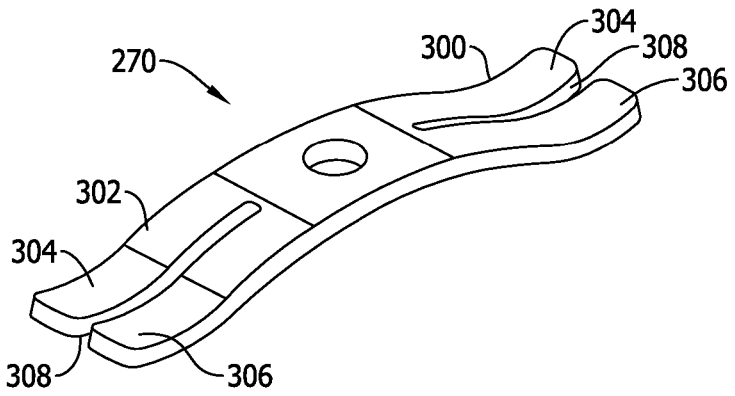
FIG. 12 illustrates an exemplary leaf spring for the switch mechanisms shown in FIGS. 7-11.

FIG. 12 is a perspective view of the leaf spring 270 described in one example. The leaf spring 270 includes forked ends 300, 302 including prongs 304, 306 separated by an opening 308. The dual sets of prongs 304, 306 facilitate the closing of the slider bar including the dual sets of switch contacts 212*a*, 212*b*, 214*a*, 214*b* described above. The material for the leaf 270 spring is selected to provide the closing contact force desired. The leaf spring 270 may be assembled with the actuator link 262 such that downward movement of the link 262 causes the leaf spring 270 to compress and release force as desired to obtain and maintain a desirable amount of contact closing force.

Figure 13:
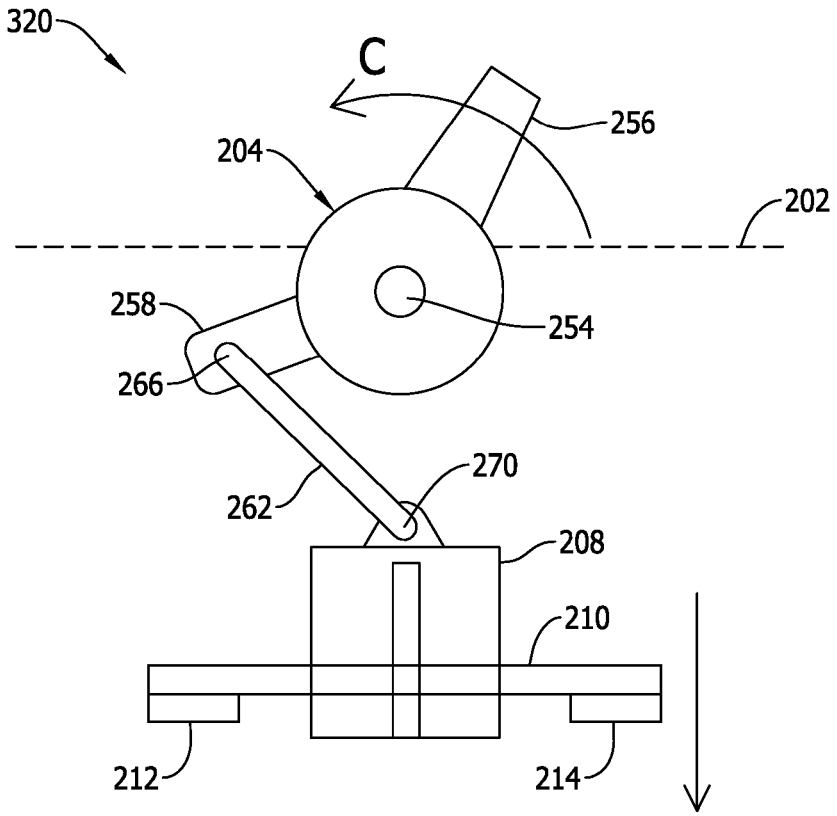
FIG. 13 is a partial illustration of an exemplary linear direct switch mechanism arrangement for a fusible switch disconnect switch according to the invention.

FIG. 13 illustrates another switch mechanism 320 that can be seen to closely correspond to the mechanism 250 described above, but omits the slot 260 in the guide element 258. As a result, the end 266 of the link 262 can rotate relative to the guide element 258, but it cannot translate relative to the guide element 258. As such, in this arrangement the link 262 is not compatible with the cam surface described above and the housing 202 accordingly does not include a cam surface. The arrangement shown in FIG. 13 is sometimes referred to as a direct linear switch mechanism. Coupled with the dual contact bar element 210 and the dual sets of switch contacts, the direct linear mechanism can effectively make and break electrical connections without excessive arcing at comparatively lower cost than the linear cam switch arrangement described above. Opened and closed positions of the switch contacts are obtained by rotating the switch actuator in opposite directions to raise or lower the slider bar 208.

Figure 14:
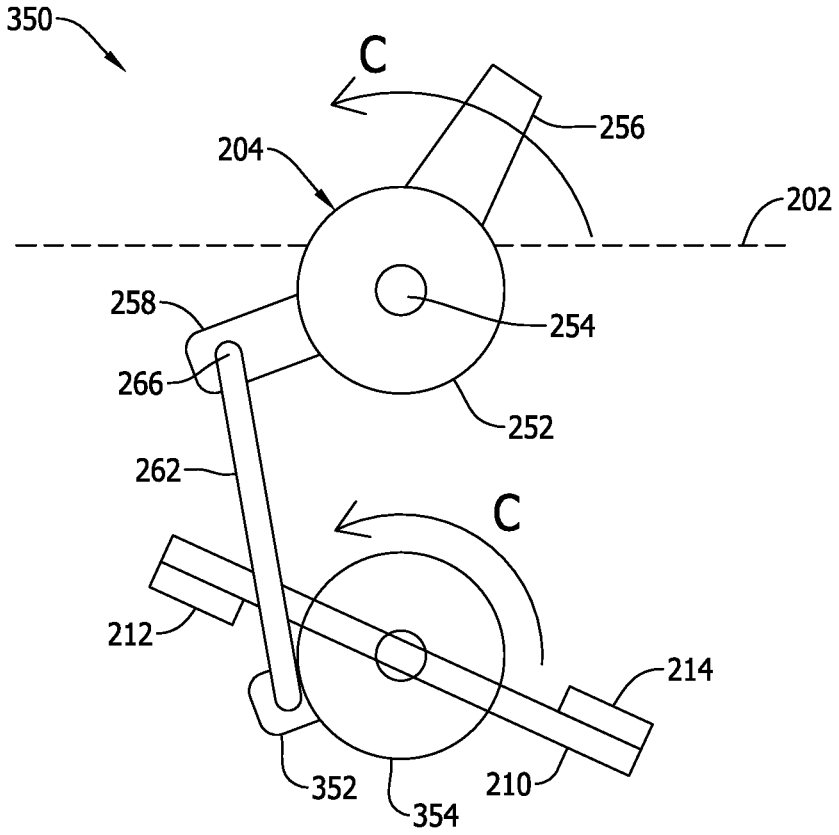
FIG. 14 is a partial illustration of an exemplary rotary switch mechanism arrangement for a fusible switch disconnect switch according to the invention.
Figure 15:
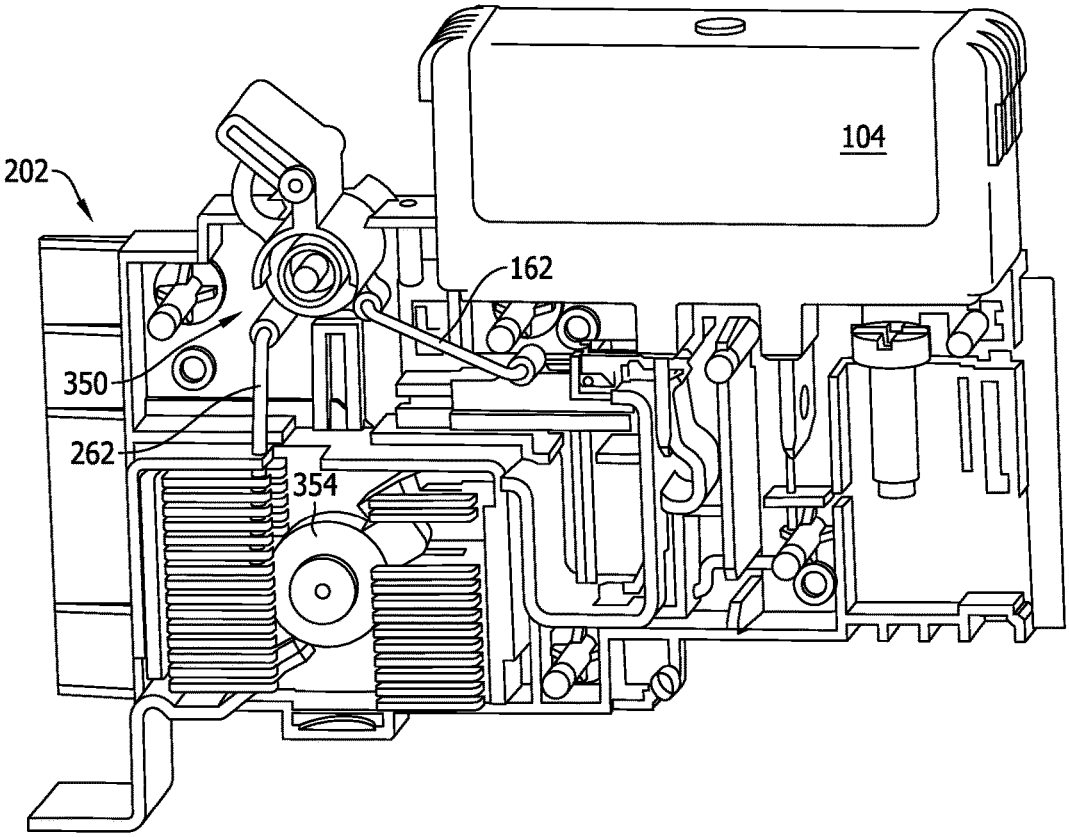
FIG. 15 is a partial illustration of the rotary switch mechanism installed in a switch disconnect device and in a closed position.
Figure 16:
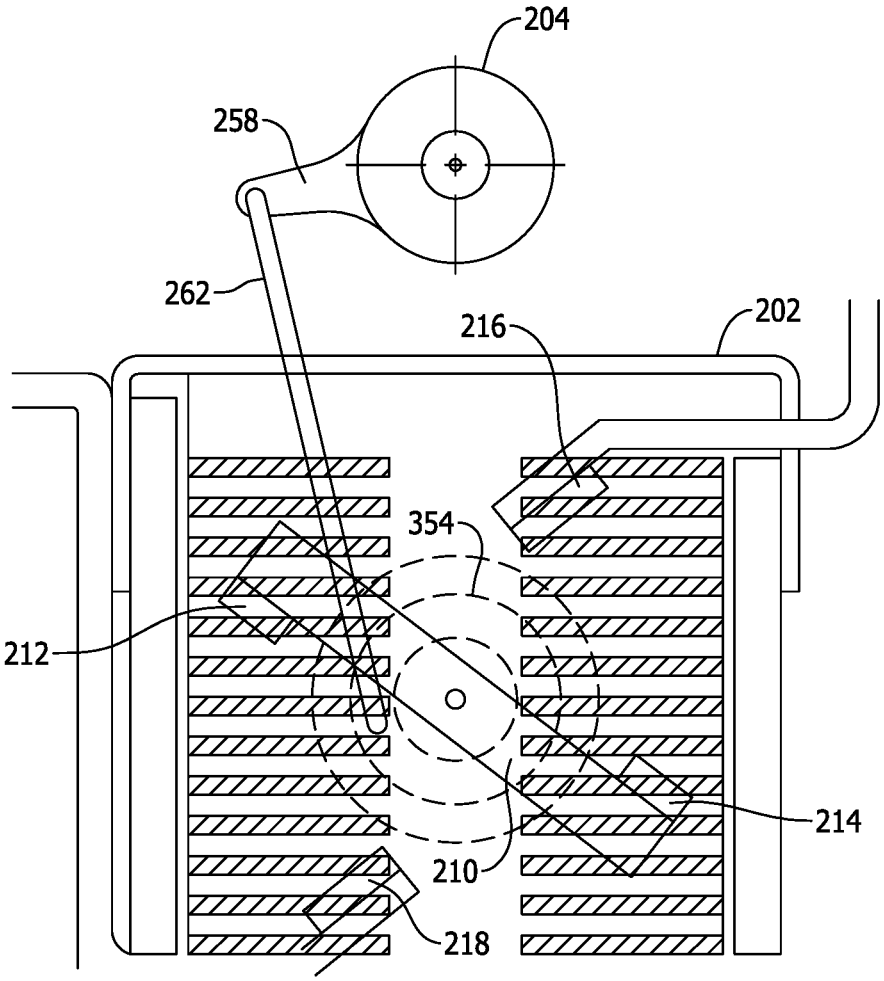
FIG. 16 is a partial illustration of the rotary switch mechanism installed in a switch disconnect device and in an opened position.

FIG. 14 illustrates another switch mechanism 350 for the device 200 that is a rotary switch mechanism. In this switch mechanism, the link 262 is coupled to the guide element 258 at the end 266 and is coupled to an extension 352 of a rotary contact member 354 to which the contact element 210 is attached. Unlike the previously described embodiments, the movable contacts 212, 214 are coupled to opposing sides of the contact element 210 and thus face in opposite directions. The rotary contact member 354 is rotatably mounted in the switch housing 202 at a distance from the switch actuator 204, and by virtue of the link 262 when the switch actuator 104 is rotated in the direction of arrow C the rotary contact member 354 is likewise rotated in the same direction. Since the contact element 202 rotates with the rotary contact member 354 the switch contacts 212, 214 (actually 212*a*, 212*b* and 214*a*, 214*b* by virtue of the dual bar contact element 210) may be engaged and disengaged from the stationary switch contacts 216, 218 (actually 216*a*, 216*b*, 218*a*, 218*b*) as shown in FIG. 6. The rotary mechanism is shown in a closed position in FIG. 15 and in an open position in FIG. 16. The opened and closed positions are obtained by rotating the switch actuator 204 in different directions. For certain applications, the rotary switch mechanism may provide additional space savings and offer further reduction in the housing size than the previously described switch mechanisms.

Figure 17:
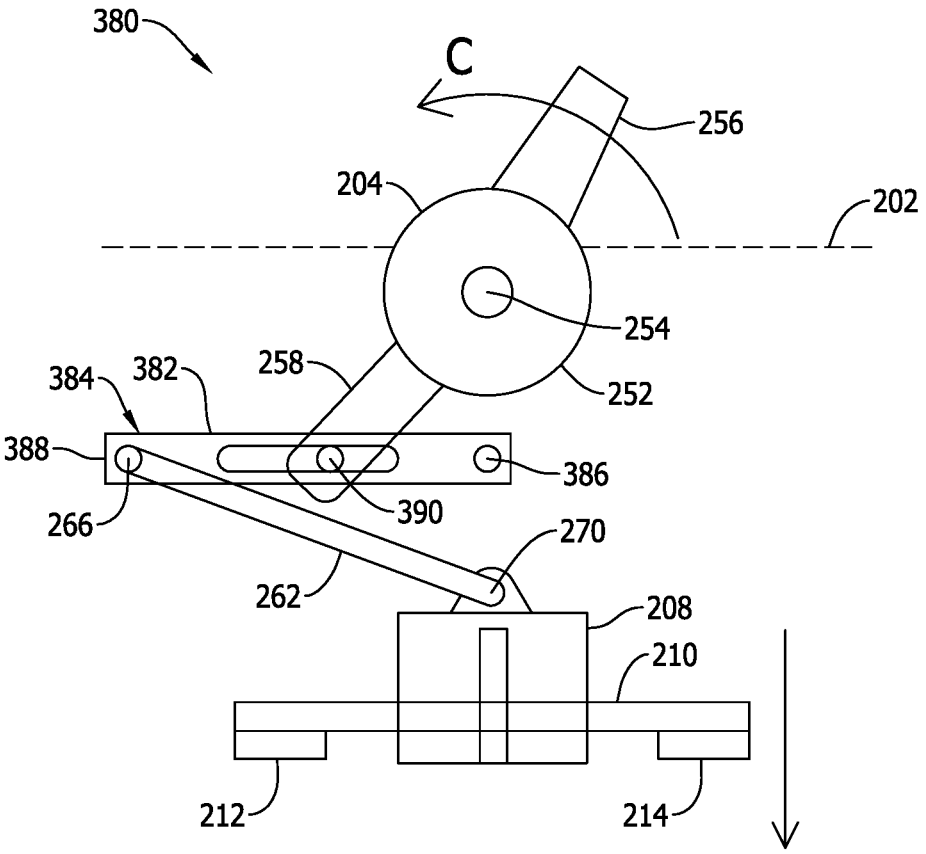
FIG. 17 is a partial illustration of an exemplary linear double rocker switch mechanism arrangement for a fusible switch disconnect switch according to the invention.
Figure 18:
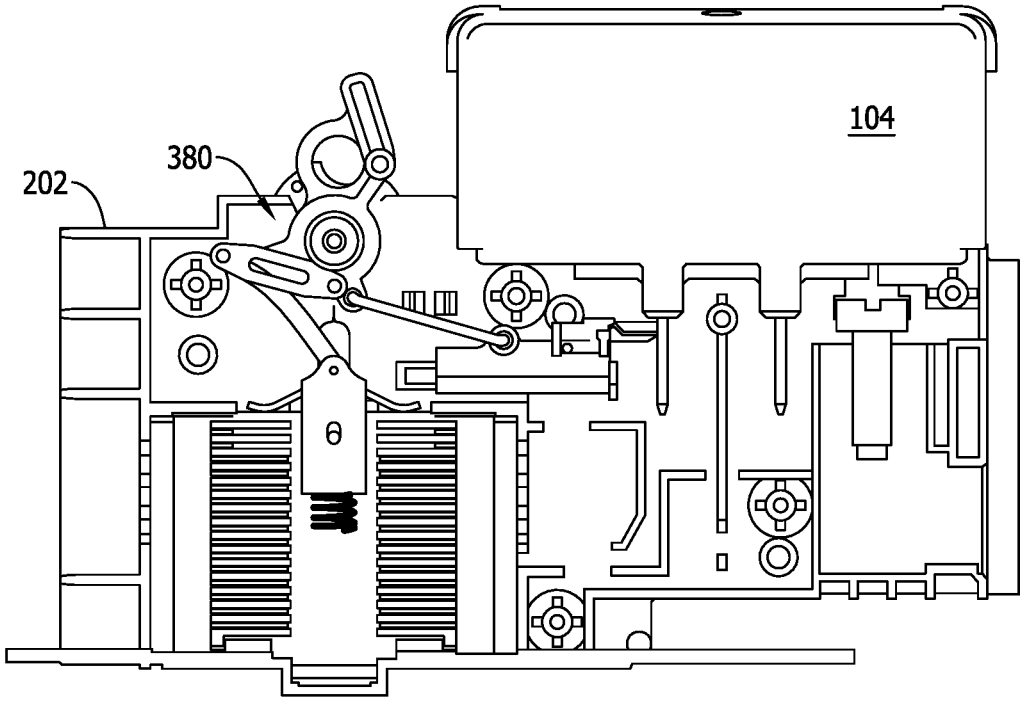
FIG. 18 is a partial illustration of the linear double rocker switch mechanism installed in a fusible switch disconnect device and in an opened position.

FIG. 17 illustrates another switch mechanism 380 for the device 200 that is a rocker switch mechanism. In this arrangement, the guide member 258 of the switch actuator 204 is interfaced with a linear slot 382 of a rocker element 384. The rocker element 384 is rotatably mounted in the housing 202 at a first end 386, and attaches to the end 266 of the link 262 at its opposite end 388. The guide member 258 may include a pin 390 that engages the slot 382 in the rocker element 384. When the switch actuator 204 is rotated in the direction of arrow C. the pin 390 that is constrained to the slot 382 causes the rocker element 384 to pivot about the end 386 in the same direction as arrow C. As the rocker element 384 pivots, the link 262 drives the slider bar 208 downward to close the switch contacts. FIG. 18 shows a more detailed implementation of the mechanism 380 in an opened position. The closed and opened positions are obtained by rotating the switch actuator 204 in opposite directions.

The benefits and advantages of the inventive fusible switch disconnect devices described are now believed to have been amply illustrated in relation to the embodiments disclosed.

An embodiment of a fusible switch disconnect device has been disclosed including: a housing configured to receive and accept an overcurrent protection fuse, a current path defined in the switch housing, wherein the current path includes first, second, third and fourth stationary switch contacts mounted to the housing; and a switch mechanism including a rotary switch actuator and first, second, third, and fourth movable switch contacts linked to the switch actuator; wherein the rotary switch actuator is selectively positionable between first and second positions to connect and disconnect the current path without removing the overcurrent protection fuse; wherein when the rotary switch actuator is moved from the first position to the second position the first, second, third, and fourth movable switch contacts are engaged to the first, second, third and fourth stationary contacts to close the circuit path through the overcurrent protection fuse; and wherein when the rotary switch actuator is moved from the second position to the first position the first, second, third, and fourth movable switch contacts are disengaged from the first, second, third and fourth stationary contacts to open the circuit path through the overcurrent protection fuse.

Optionally, the housing may include opposed top and bottom surfaces and each of the first, second, third, and fourth stationary switch contacts are located adjacent the bottom surface. The bottom surface may include a pocket, the pocket separating the first and second stationary switch contact from the third and fourth stationary switch contact. The switch mechanism may include a slider bar, the slider bar descending into the pocket when the current path is closed.

The switch mechanism may also include a slider bar movable along a linear axis within the housing. A contact element may be carried on the slider bar, with the first, second, third, and fourth movable switch contacts carried on the slider bar. The contact element may be a dual bar contact element, with one of the dual bars carrying the first and second movable switch contacts, and the other of the dual bars carrying the third and fourth movable switch contacts. The switch mechanism may further include a leaf spring acting on the contact element. The leaf spring may include forked ends.

The switch mechanism may include a link coupled to the rotary switch actuator and causing the slider bar to move along the linear axis when the rotary switch actuator is rotated. The link may be rotatably coupled to the rotary switch actuator but is not translatable relative to the slider bar. The rotary switch actuator may include an elongated slot receiving an end of the link, with the housing further comprising a cam surface cooperating with the end of the link. The cam surface may include at least one linear portion. The linear portion may extend parallel to the linear axis. The cam surface further may further include at least one arcuate portion, and the at least one arcuate portion may be designed to over-compress the switch contacts. A rocker element may be coupled between the rotary switch actuator and the slider bar.

The switch mechanism may also include a contact element, and wherein at least two of the stationary first, second, third and fourth stationary contacts face in opposite directions from the contact element. The switch mechanism may also include a rotary contact element and a link coupling the rotary switch actuator and the rotary contact element, the link causing the rotary contact element to rotate when the rotary switch actuator is rotated.

The overcurrent protection fuse may optionally be a rectangular fuse module having plug-in terminal blades.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fusible switch disconnect device comprising:

a housing including opposed top and bottom surfaces, the top surface configured to receive and accept an overcurrent protection fuse and the bottom surface formed with a pocket extending from the bottom surface;

a current path defined in the switch housing and connecting to the overcurrent protection fuse when received, the current path including at least first and second stationary switch contacts proximate the bottom surface on respectively different sides of the pocket; and a switch mechanism selectively positionable between first and second positions to connect and disconnect the current path without removing the overcurrent protection fuse, the switch mechanism comprising:

a rotary switch actuator selectively positionable between first and second positions to cause the current path to open or close while the overcurrent protection fuse is connected; and a contact element, responsive to the position of the rotary switch actuator, and carrying at least two movable switch contacts for selective engagement with the at least first and second stationary switch contacts, wherein a portion of the contact element descends into the pocket when the current path is closed;

wherein the switch mechanism further comprises a link having a first end and a second end, the first end coupled to the rotary switch actuator and the second end coupled to the contact element;

wherein the rotary switch actuator defines an elongated guide member receiving the first end of the link, and wherein the housing comprises a cam surface cooperating with the first end of the link; and wherein the cam surface includes at least one arcuate portion.

2. The fusible switch disconnect device of claim 1, wherein the contact element carrying at least two movable switch contacts includes dual pairs of movable switch contacts.

3. The fusible switch disconnect device of claim 1, wherein the contact element is a slider bar movable along a linear axis within the housing.

4. The fusible switch disconnect device of claim 1, the switch mechanism further comprising a leaf spring acting on the contact element.

5. The fusible switch disconnect device of claim 4, wherein the leaf spring includes forked ends.

6. The fusible switch disconnect device of claim 1, wherein the cam surface further includes at least one linear portion.

7. The fusible switch disconnect device of claim 6, wherein the linear portion extends parallel to an axis of motion of the contact element.

8. The fusible switch disconnect device of claim 1, wherein the at least one arcuate portion is designed to over-compress the at least two movable switch contacts when engaged to the at least first and second stationary switch contacts.

9. The fusible switch disconnect device of claim 1, wherein the elongate guide member defines a slot.

10. The fusible switch disconnect device of claim 9, wherein the first end of the link may rotate and translate relative to the slot.

11. The fusible switch disconnect device of claim 9, wherein the slot is an elongated linear slot.

12. The fusible switch disconnect device of claim 1, wherein the second end of the link may rotate, but not translate, relative to the contact element.

13. The fusible switch disconnect device of claim 1, wherein the link is a linear link.

14. The fusible switch disconnect device of claim 1, wherein the link extends obliquely to an axis of motion of the contact element when the switch actuator is in the first position.

15. The fusible switch disconnect device of claim 1, wherein the link extends parallel to an axis of motion of the contact element when the switch actuator is in the second position.

16. The fusible switch disconnect device of claim 1, wherein the cam surface includes a first portion and a second portion extending perpendicular to the second portion.

17. The fusible switch disconnect element of claim 1, wherein the housing is configured to accept a rectangular overcurrent protection fuse module having plug-in terminal blades.

18. A fusible switch disconnect device comprising:

a housing including opposed top and bottom surfaces, the top surface configured to receive and accept an overcurrent protection fuse and the bottom surface formed with a pocket extending from the bottom surface;

a current path defined in the switch housing and connecting to the overcurrent protection fuse when received, the current path including at least first and second stationary switch contacts proximate the bottom surface on respectively different sides of the pocket; and a switch mechanism selectively positionable between first and second positions to connect and disconnect the current path without removing the overcurrent protection fuse, the switch mechanism comprising:

a rotary switch actuator selectively positionable between first and second positions to cause the current path to open or close while the overcurrent protection fuse is connected; and a contact element, responsive to the position of the rotary switch actuator, and carrying at least two movable switch contacts for selective engagement with the at least first and second stationary switch contacts, wherein a portion of the contact element descends into the pocket when the current path is closed;

wherein the switch mechanism further comprises a link having a first end and a second end, the first end coupled to the rotary switch actuator and the second end coupled to the contact element;

wherein the rotary switch actuator defines an elongated guide member receiving the first end of the link;

wherein the housing comprises a cam surface cooperating with the first end of the link; and wherein the elongated guide member defines a slot.

19. The fusible switch disconnect device of claim 18, wherein the first end of the link may rotate and translate relative to the slot.

20. The fusible switch disconnect device of claim 18, wherein the slot is an elongated linear slot.

21. The fusible switch disconnect device of claim 18, wherein the cam surface includes at least one arcuate portion.

22. The fusible switch disconnect device of claim 21, wherein the at least one arcuate portion is designed to over-compress the at least two movable switch contacts when engaged to the at least first and second stationary switch contacts.

23. The fusible switch disconnect device of claim 21, wherein the cam surface further includes at least one linear portion.

24. The fusible switch disconnect device of claim 18, the switch mechanism further comprising a leaf spring acting on the contact element.

25. The fusible switch disconnect device of claim 24, wherein the leaf spring includes forked ends.

26. The fusible switch disconnect device of claim 18, wherein the cam surface includes a first portion and a second portion extending perpendicular to the second portion.

* * * * *